US006114106A

United States Patent [19]

Fujiwara et al.

[11] Patent Number: 6,114,106

[45] Date of Patent: Sep. 5, 2000

[54] PHOTOTHERMOGRAPHIC MATERIAL

[75] Inventors: Itsuo Fujiwara; Ichizo Toya, both of Kanagawa, Japan

[73] Assignee: Fuji Photo Film Co., Ltd., Kanagawa, Japan

[21] Appl. No.: 09/318,770

[22] Filed: May 26, 1999

[30] Foreign Application Priority Data

May 26, 1998 [JP] Japan ..... 10-161465
May 26, 1998 [JP] Japan ..... 10-161466

[51] Int. Cl.[7] ..... G03C 1/498; G03C 1/825

[52] U.S. Cl. ..... 430/619; 430/510; 430/517

[58] Field of Search ..... 430/517, 619, 430/510

[56] References Cited

U.S. PATENT DOCUMENTS 3,152,904 10/1964 Sorensen et al. .
3,457,075 7/1969 Morgan et al. .
5,840,469 11/1998 Bjork et al. ..... 430/619

*Primary Examiner*—Thorl Chea
*Attorney, Agent, or Firm*—Birch, Stewart, Kolasch & Birch, LLP

[57] ABSTRACT

The present invention provides a photothermographic material which can provide an image having a high sharpness, exhibits a good transparency, is less liable to fog and is unsusceptible to discoloration during storage. The present invention also provides a photothermographic material which can provide a less fogged image having a high sharpness without using any mercury compound. A photothermographic material is provided comprising an anti-irradiation pigment incorporated in a photosensitive layer and an anti-irradiation dye incorporated in at least one light-insensitive layer on the same side of a support as the photosensitive layer.

8 Claims, 1 Drawing Sheet

PHOTOTHERMOGRAPHIC MATERIAL

FIELD OF THE INVENTION

The present invention relates to a photothermographic material. More particularly, the present invention relates to a photothermographic material which exhibits a good sharpness and a high transparency and is little liable to discoloration (fading) during storage.

BACKGROUND OF THE INVENTION

A photothermographic material has long been proposed. Photothermographic materials are described in, e.g., U.S. Pat. Nos. 3,152,904 and 3,457,075, and B. Shely, "Thermally Processed Silver System", Imaging Processes and Materials, Neblette, 8th ed., Sturge, V. Walworth, A. Shepp, page 2, 1996.

In general, a photothermographic material comprises a photosensitive layer having a catalytically active amount of a photocatalyst (e.g., silver halide), a reducing agent, a reducible silver salt (e.g., organic silver) and a toning agent for controlling the tone of silver dispersed in a binder matrix.

A photothermographic material is imagewise exposed to light, and then heated to a temperature as high as, e.g., not lower than 80° C. so that the silver halide or reducible silver salt (which acts as an oxidizing agent) and the reducing agent undergo redox reaction with each other to form a black silver image. The redox reaction is accelerated by the catalytic action of a silver halide latent image which has been generated upon exposure. Therefore, the black silver image is formed on the exposed area.

The heat development process doesn't require the use of a processing solution as used in wet development process and thus is advantageous in that it can be effected simply and rapidly. However, the wet development process is still mostly used to form an image in the art of photography. This is because the heat development process has some problems unresolved unlike the wet development process.

It is known that a photographic light-sensitive material has constituent layers colored for the purpose of inhibiting irradiation. Irradiation is a phenomenon that light which has entered into a photosensitive layer undergoes reflection or diffusion inside the emulsion to make even the periphery of the normal image to be exposed to light. The use of such an anti-irradiation technique makes it possible to enhance sharpness. However, a photothermographic material is disadvantageous in that it is liable to increased development fog or discoloration during storage or, even if no discoloration occurs during storage, exhibits a reduced transparency or absorbance if it comprises a colorant incorporated therein.

If such an anti-irradiation dye is incorporated in the photosensitive layer, it can have an effect on the heat development, causing an increase in the generation of fog.

On the other hand, as a technique for inhibiting fog there has heretofore been practiced the use of mercury compound. However, such a mercury compound is not desirable from the environmental standpoint of view. Thus, alternative techniques have been studied. As such compounds there have been proposed various compounds such as organic halogen compound.

However, such a fog inhibitor other than mercury compounds is not sufficient for the effect of inhibiting fog exerted by the incorporation of the foregoing irradiation inhibitor in the photosensitive layer.

SUMMARY OF THE INVENTION

It is therefore an object of the present invention to provide a photothermographic material which can provide an image having a high sharpness, exhibits a good transparency, is less liable to fog and is unsusceptible to discoloration during storage.

It is another object of the present invention to provide a photothermographic material which can provide a less fogged image having a high sharpness without using any mercury compound.

These and other objects of the present invention will become more apparent from the following detailed description and examples.

The foregoing objects of the present invention are accomplished with the following aspects of the present invention:

(1) A photothermographic material comprising an anti-irradiation pigment incorporated in a photosensitive layer and an anti-irradiation dye incorporated in at least one light-insensitive layer on the same side of a support as the photosensitive layer.

(2) The photothermographic material according to Clause (1), wherein the photosensitive layer comprises a polyhalogen compound.

(3) The photothermographic material according to Clause (1), wherein at least one layer on the same side of a support as the photosensitive layer is free of mercury compound and comprises a polyhalogen compound.

(4) The photothermographic material according to Clause (1), wherein all layers on the same side of a support as the photosensitive layer exhibits a total anti-irradiation optical density of from not less than 0.05 to not more than 2.0.

(5) The photothermographic material according to Clause (1), wherein all layers on the photosensitive layer side of the support exhibits a total anti-irradiation optical density of from not less than 0.05 to not more than 1.0.

(6) The photothermographic material according to Clause (1), wherein the photosensitive layer exhibits an anti-irradiation optical density of from not less than 0.05 to not more than 1.0 and the light-insensitive layer is colored by not less than 30% of the total anti-irradiation optical density of the layers on the photosensitive layer side of the support.

(7) The photothermographic material according to Clause (1), wherein the light-insensitive layer is colored by not less than 50% of the total anti-irradiation optical density of the layers on the photosensitive layer side of the support.

(8) The photothermographic material according to Clause (1), wherein the photosensitive layer comprises an organic silver salt, a reducing agent and a photosensitive silver halide.

(9) The photothermographic material according to Clause (8), wherein the photosensitive silver halide is spectrally sensitized.

BRIEF DESCRIPTION OF THE DRAWINGS

By way of example and to make the description more clear, reference is made to the accompanying drawings in which.

DETAILED DESCRIPTION OF THE INVENTION

Figure 1:
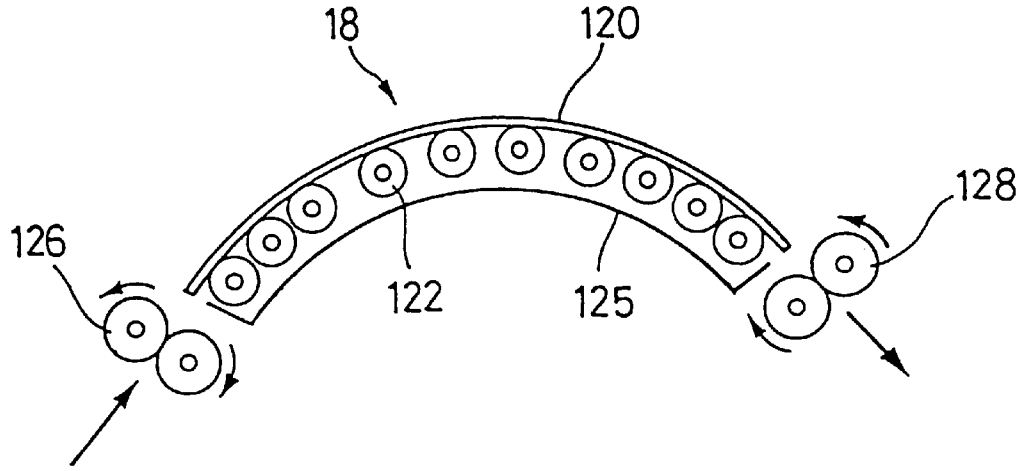
FIG. 1 is a schematic diagram illustrating an example of the heat development zone in a heat development apparatus used in the present invention.

The present invention will be further described hereinafter.

The photothermographic material according to the present invention comprises an anti-irradiation pigment incorporated in a photosensitive layer and an anti-irradiation dye incorporated in at least one light-insensitive layer on the same side of a support as the photosensitive layer. The reason why the photosensitive layer comprises a pigment incorporated therein is because a pigment can reduce the generation of fog and inhibit discoloration during storage as compared with a dye. The foregoing arrangement makes it possible to inhibit irradiation and halation and hence provide a photothermographic material having an excellent sharpness and a reduced Dmin (minimum density) resulting in an excellent transparency. On the contrary, the incorporation of only a pigment in the light-insensitive layer causes an increase in Dmin. Further, if a pigment is incorporated in only the photosensitive layer and no anti-irradiation dye or pigment is incorporated in the light-insensitive layer, there occurs an increase in Dmin and the generation of fog. In other words, in order to realize a good sharpness and reduced fog and Dmin at the same time, it is necessary that the photosensitive layer comprise an anti-irradiation pigment incorporated therein while the light-insensitive layer comprise an anti-irradiation dye incorporated therein in accordance with the present invention.

In the present invention, as the pigment to be incorporated in the photosensitive layer there may be used a known pigment described in various references besides commercially available compounds. Examples of these references include Color Index (The Society of Dyers and Colourists), "Revised Edition of Handbook of Pigments", Japan Society of Pigment Technology (1989), "Modern Applied Technique of Pigments", CMC (1986), "Printing Ink Technology", CMC (1984), and W. Herbist and K. Hunger, "Industrial Organic Pigments", VCH Verlagsgesellschaft, 1993. Specific examples of such a pigment include organic pigments such as azo pigment (e.g., azo lake pigment, insoluble azo pigment, condensed azo pigment, chelate azo pigment), polycyclic pigment (e.g., phthalocyanine pigment, anthraquinone pigment, perylene pigment, perynone pigment, indigo pigment, quinacridone pigment, dioxazine pigment, isoindolinone pigment, quinophthalone pigment, diketopyrolopyrrole pigment), dyed lake pigment (e.g., acidic or basic dye lake pigment) and azine pigment, and inorganic pigments. Among these pigments, phthalocyanine pigment, anthraquinone indanthrone pigment, dyed lake pigment-based triaryl carbonium pigment, indigo, and inorganic pigments such as ultramarine, Prussian blue and cobalt blue can be preferably used to obtain a desirable bluish color tone. The foregoing bluish pigment may be used in combination with a red or purple pigment such as dioxazine pigment, quinacridone pigment and diketopyrolopyrrole pigment to adjust the color tone.

Specific examples of preferred pigments will be given below.

Examples of bluish pigments include phthalocyanine pigments such as C. I. Pigment Blue 15, C. I. Pigment Blue 15:1, C. I. Pigment Blue 15:2, C. I. Pigment Blue 15:3, C. I. Pigment Blue 15:4 and C. I. Pigment Blue 15:6 (copper phthalocyanine), monochloro or slightly chlorinated copper phthalocyanine, C. I. Pigment Blue 16 (metal-free phthalocyanine), phthalocyanine comprising Zn, Al or Ti as a central metal, indanthrone-based C. I. Pigment Blue 60 known also as vat dye, halogen substitution product thereof such as C. I. Pigment Blue 64 and C. I. Pigment Blue 21, azo-based C. I. Pigment Blue 25, indigo-based C. I. Pigment Blue 66, C. I. Pigment Blue 63 as a lake pigment, and triaryl carbonium type acidic dye or basic dye-based lake pigments such as C. I. Pigment 1, C. I. Pigment 2, C. I. Pigment 3, C. I. Pigment 9, C. I. Pigment 10, C. I. Pigment 14, C. I. Pigment 18, C. I. Pigment 19, C. I. Pigment 24:1, C. I. Pigment 24:x, C. I. Pigment 56, C. I. Pigment 61 and C. I. Pigment 62. Examples of red or purple pigments include dioxazine pigments such as C. I. Pigment Violet 23 and C. I. Pigment Violet 37, azo pigments such as C. I. Pigment Violet 13, C. I. Pigment Violet 25, C. I. Pigment Violet 32, C. I. Pigment Violet 44, C. I. Pigment Violet 50, C. I. Pigment Red 23, C. I. Pigment Red 52:1, C. I. Pigment Red 57:1, C. I. Pigment Red 63:2, C. I. Pigment Red 146, C. I. Pigment Red 150, C. I. Pigment Red 151, C. I. Pigment Red 175, C. I. Pigment Red176, C. I. Pigment Red 185, C. I. Pigment Red 187 and C. I. Pigment Red 245, quinacridone pigments such as C. I. Pigment Violet 19, C. I. Pigment Violet 42, C. I. Pigment Red 122, C. I. Pigment Violet 192, C. I. Pigment Violet 202, C. I. Pigment Violet 207 and C. I. Pigment Violet 209, triaryl carbonium-based lake pigments such as C. I. Pigment Violet 1, C. I. Pigment Violet 2, C. I. Pigment Violet 3, C. I. Pigment Violet 27, C. I. Pigment Violet 39 and C. I. Pigment Red 81:1, perylene pigments such as C. I. Pigment Violet 29, anthraquinone pigments such as C. I. Pigment Violet 5:1, C. I. Pigment Violet 31 and C. I. Pigment Violet 33, and thioindigo pigments such as C. I. Pigment Red 38 and C. I. Pigment Red 88.

As the pigment to be used herein there may be used the foregoing pigment as it is or in surface-treated form. Examples of possible processes for the surface treatment of the pigment include a process which comprises coating the surface of the pigment with a resin or wax, a process which comprises attaching a surface active agent to the surface of the pigment, and a process which comprises bonding a reactive material (e.g., silane coupling agent, epoxy compound, polyisocyanate) to the surface of the pigment. These processes are described in, e,g, the following references.

Properties and Application of Metal Soap (Saiwai Shobo)

Printing Ink Technology (CMC, 1984)

Modern Applied Technique of Pigments (CMC, 1986)

In the present invention, the pigment is used in the form of dispersion in a binder. As the dispersing agent there may be any dispersing agent depending on the kind of the binder and pigment used. For example, a surface active agent type low molecular dispersing agent or high molecular dispersing agent may be used. If the pigment is used in the form of dispersion in a hydrophobic binder, a high molecular dispersing agent is preferably used from the standpoint of dispersion stability. Examples of the dispersing agent employable herein include those described in JP-A-3-69949 (The term "JP-A" as used herein means an "unexamined published Japanese patent application") and EP 549,486.

The pigment of the present invention which has been dispersed preferably has an average particle diameter of from 0.01 to 10 $\mu$m, more preferably from 0.05 to 1 $\mu$m.

As the method for dispersing the pigment in the binder there may be used a known dispersion technique for use in the production of ink or toner. Examples of the dispersing machine to be used in the dispersion of the pigment in the binder include sand mill, attritor, pearl mill, supermill, ball mill, impeller, disperser, KD mill, colloid mill, dynatron, three-roll mill, and pressure kneader. For details, reference can be made to "Modern Applied Technique of Pigments" (CMC, 1986).

The color density (anti-irradiation optical density) of the photosensitive layer is preferably from 0.01 to 1.0, more preferably from 0.03 to 0.5, even more preferably from 0.05 to 0.5, particularly from 0.05 to 0.3 as calculated in terms of absorbance in the wavelength to which the photosensitive layer is sensitive to exert a substantial effect on image quality such as sharpness. If the photosensitive layer is composed of a plurality of layers, the sum of the color density of these layers is taken into account.

Examples of the dye to be incorporated in the light-insensitive layer on the photosensitive layer side of the support include oxonol dyes having pyrazolone nucleus or barbituric acid nucleus described in British Patent Nos. 506,385, 1,177,429, 1,311,884, 1,338,799, 1,385,371, 1,467,214, 1,433,102 and 1,553,516, JP-A-48-85,130, JP-A-49-114,420, JP-A-52-117,123, JP-A-55-161,233, JP-A-59-111,640, JP-B-39-22,069 (The term "JP-B" as used herein means an "examined Japanese patent publication"), JP-B-43-13,168, JP-B-62-273,527, and U.S. Pat. Nos. 3,247,127, 3,469,985 and 4,078,933, other oxonol dyes described in U.S. Pat. Nos. 2,533,472 and 3,379,533, and British Patent No. 1,278,621, azo dyes described in British Patent Nos. 575,691, 680,631, 599,623, 786,907 and 1,045,609, U.S. Pat. No. 4,255,326, and JP-A-59-211,043, anthraquinone dyes described in JP-A-50-100,116, JP-A-54-118,247, and U.S. Pat. Nos. 2,014,598 and 750,031, arylidene dyes described in U.S. Pat. Nos. 2,538,009, 2,688,541 and 2,538,008, British Patent Nos. 584,609 and 1,210,252, JP-A-50-40,625, JP-A-51-3,623, JP-A-51-10,927, JP-A-54-118,247, JP-B-48-3,286, and JP-B-59-37,303, styryl dyes described in JP-B-28-3,082, JP-B-44-16,594, and JP-B-59-28,898, triarylmethane dyes described in British Patent Nos. 446,583 and 1,335,422 and JP-A-59-228,250, melocyanine dyes described in British Patent Nos. 1,075,653, 1,153,341, 1,284,730, 1,475,228 and 1,542,807, and cyanine dyes described in U.S. Pat. Nos. 2,843,486 and 3,294,539. Further, so-called squarilium dyes and chroconium dyes may be used. Moreover, the foregoing pigments may be used.

Particularly preferred among these dyes are those represented by the following formulae (I), (II), (III), (IV), (V) and (VI):

(I)

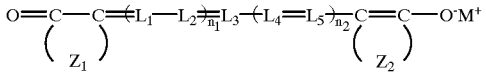

In the formula (I), $Z_1$ and $Z_2$ may be the same or different and each represents a non-metallic group required to form a heterocycle; $L_1$ to $L_5$ each represents a methine group; $n_1$ and $n_2$ each represents an integer of 0 or 1; and $M^+$ represents a hydrogen atom or monovalent cation.

(II)

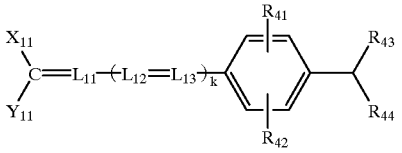

In the formula (II), $X_{11}$, and $Y_{11}$ maybe the same or different and each represents an electron withdrawing group. $X_{11}$ and $Y_{11}$ may be connected to each other to form a ring.

$R_{41}$ and $R_{42}$ may be the same or different and each represents a hydrogen atom, halogen atom, alkyl group, alkoxyl group, hydroxyl group, carboxyl group, substituted amino group, carbamoyl group, sulfamoyl group, alkoxycarbonyl group or sulfo group.

$R_{43}$ and $R_{44}$ maybe the same or different and each represents a hydrogenatom, alkyl group, alkenyl group, aryl group, acyl group or sulfonyl group. $R_{43}$ and $R_{44}$ may be connected to each other to form a ring. $X_{11}$, $Y_{11}$, $R_{41}$, $R_{42}$, $R_{43}$ and $R_{44}$ each may contain sulfo group or carboxyl group as a substituent.

$L_{11}$, $L_{12}$ and $L_{13}$ each represents a methine group. The suffix k represents an integer of 0 or 1.

$$Ar_1—N=N—Ar_2 \quad (II)$$

In the formula (III), $Ar_1$ and $Ar_2$ may be the same or different and each represents a substituted or unsubstituted aryl group or substituted heterocyclic group.

(IV)

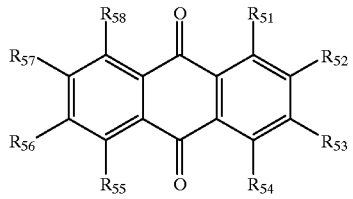

In the formula (IV), $R_{51}$, $R_{54}$, $R_{55}$ and $R_{58}$ may be the same or different and each represents a hydrogen atom, alkyl group, aryl group, hydroxyl group, alkoxyl group, aryloxy group, carbamoyl group, amino group or substituted amino group.

$R_{52}$, $R_{53}$, $R_{56}$ and $R_{57}$ may be the same or different and each represents a hydrogen atom, alkyl group, aryl group, hydroxyl group, alkoxyl group, amino group, sulfo group or carboxyl group.

(V)

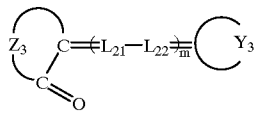

In the formula (V), $L_{21}$ and $L_{22}$ each represents a substituted or unsubstituted methine group or nitrogen atom. The suffix m represents an integer of 0, 1, 2 or 3.

$Z_3$ represents a non-metallic atom group required to form a pyrazolone nucleus, hydroxypyridone nucleus, barbituric acid nucleus, thiobarbituric acid nucleus, dimedone nucleus, indan-1,3-dion nucleus, rhodanine nucleus, thiohydantoin nucleus, oxazolidine-4-on-2-thion nucleus, homophthalimide nucleus, pyrimidine-2,4-dion nucleus or 1,2,3,4-tetrahydroquinoline-2,4-dion nucleus.

$Y_3$ represents a non-metallic atom group required to form an oxazole nucleus, benzoxazole nucleus, naphthoxazole nucleus, thiazole nucleus, benzothiazole nucleus, naphthothiazole nucleus, benzoselenazole nucleus, pyridine nucleus, quinoline nucleus, benzoimidazole nucleus, naphthoimidazole nucleus, imidazoquinoxaline nucleus, indolenine nucleus, isoxazole nucleus, benzoisoxazole nucleus, naphthoisoxazole nucleus or acridine nucleus. $Z_3$ and $Y_3$ may further contain substituents.

Formula (VI):

(VI)

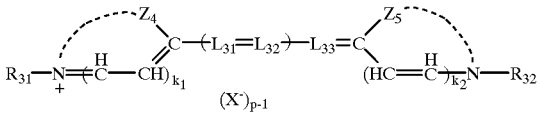

or (VI)

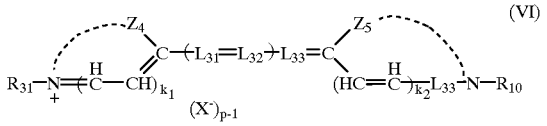

In the formula (VI), $R_{31}$ and $R_{32}$ maybe the same or different and each represents a substituted or unsubstituted alkyl group.

$L_{31}$, $L_{32}$ and $L_{33}$ may be the same or different and each represents a substituted or unsubstituted methine group. The suffix $m_1$ represents an integer of 0, 1, 2 or 3.

$L_{31}$ to $L_{33}$, which are adjacent to each other, may together form a 4-, 5- or 6-membered ring.

$Z_4$ and $Z_5$ may be the same or different and each represents a non-metallic atom group required to form a substituted or unsubstituted heterocycle. The suffixes $k_1$ and $k_2$ each represents an integer of 0 or 1.

$X^-$ represents an anion. The suffix p represents an integer of 1 or 2. If the compound forms an intramolecular salt, p is 1.

The foregoing dye may be added in the form of solution, emulsion, solid particle dispersion or high molecular mordant.

Examples of the light-insensitive layer on the photosensitive layer side of the support include so-called undercoating layer, anti-halation layer, protective layer (layer disposed farther from the support than the photosensitive layer), interlayer disposed between the photosensitive layer and the protective layer, and interlayer and other layers, if the photosensitive layer is composed of a plurality of layers.

These light-insensitive layers are normally transparent. Thus, when the photographic light-sensitive material is imagewise exposed to light, diffusion can occur not only in the photosensitive layer but also in these light-insensitive layers to give blurred image. Accordingly, as previously mentioned, these light-insensitive layers, too, are colored to inhibit irradiation and halation.

The color density (anti-irradiation optical density) of the light-insensitive layer is preferably from 0.01 to 1.0, particularly from 0.03 to 0.5 as calculated in terms of absorbance in the wavelength to which the light-in sensitive layer is sensitive. If the light-insensitive layer is composed of a plurality of layers, the sum of the color density of these layers is taken into account.

The proportion of the content of anti-irradiation colorant in the photosensitive layer and the light-insensitive layer is preferably such that the anti-irradiation optical density of the light-insensitive layer accounts for not less than 30%, preferably not less than 50%, more preferably not less than 60% of the total anti-irradiation optical density.

By thus predetermining the anti-irradiation optical density of the photosensitive layer to a range of from not less than 0.05 to not more than 1.0 and the anti-irradiation optical density of the light-insensitive layer to not less than 30% of the total anti-irradiation optical density to exert a substantial effect on image quality such as sharpness, irradiation or halation can be effectively inhibited, a good sharpness can be realized, and the generation of fog can be reduced.

The color density of all layers on the photosensitive layer side of the support is preferably from not less than 0.05 to not more than 2.0, more preferably from not less than 0.05 to not more than 1.0, even more preferably from not less than 0.1 to not more than 1.0, particularly from not less than 0.1 to not more than 0.7, as calculated in terms of absorbance at the wavelength to which they are sensitive.

The color density can be determined, e.g. by preparing a photographic light-sensitive material sample comprising a colorant incorporated in the layer in question in the same manner as in the photographic light-sensitive material, measuring the optical density (absorbance) at the wavelength to which it is sensitive, and then subtracting the optical density (absorbance) of a photographic light-insensitive material free of colorant in the layer in question from the measurements. The measurement of absorbance can be easily effected by means of a well-known spectrophotometer.

In this respect, if there are two or more photosensitive layers and light-insensitive layers, the sum of the anti-irradiation optical density of these layers is taken into account. Examples of the light-insensitive layer include undercoating layer provided interposed between the photosensitive layer and the support, protective layer provided on the photosensitive layer (layer disposed farther from the support than the photosensitive layer), and interlayer disposed between a plurality of photosensitive layers or between the photosensitive layer and the protective layer. Since there are normally two or more light-insensitive layers, the sum of the anti-irradiation optical density of these layers is taken into account.

The term "undercoating layer" as used herein is meant to indicate a layer provided directly on the support which is other than the photosensitive layer. The undercoating layer may be provided on either the photosensitive layer side or the back layer side. The undercoating layer may be provided with not only adhesivity but also antistatic effect, anti-halation properties, crossover cut properties, dyability, ultraviolet cut properties, matting properties, scratch resistance, etc.

The undercoating layer provided with adhesivity can be obtained by a so-called double-layer method which comprises providing a layer adhesive to the support as a first layer (hereinafter referred to as "first undercoating layer"), and then providing a layer which can bond the first undercoating layer to the photosensitive layer on the first undercoating layer as a second layer (hereinafter referred to as "second undercoating layer") or by a single-layer method involving the provision of only a layer which can bond the support to the photosensitive layer.

As the first undercoating layer to be used in the double-layer method there may be used a copolymer produced as a starting material monomers selected from the group consisting of vinyl chloride, vinylidene chloride, butadiene, vinyl acetate, styrene, acrylonitrile, methacrylic acid ester, methacrylic acid, acrylic acid, itaconic acid and maleic anhydride, epoxy resin, gelatin, nitrocellulose, polyvinyl acetate or the like. If necessary, the first undercoating layer may a crosslinking agent such as triazine-based crosslinking agent, epoxy-based crosslinking agent, melamine-based crosslinking agent, isocyanate containing block isocyanate, aziridine-based crosslinking agent and oxazalin-based crosslinking agent, an inorganic particulate material such as colloidal silica, a surface active agent, a thickening agent, a dye, a preservative or the like incorporated therein (For details, reference can be made to E. H. Inmmergut, "Polymer Handbook", VI, pp. 187–231, Interscience Pub. New York 1966, JP-A-50-39528, JP-A-50-47196, JP-A-50-63881, JP-A-51-133526, JP-A-64-538, JP-A-63-174698, Japanese Patent Application No. 1-240965, JP-A-1-240965, JP-A-2-184844, JP-A-48-89870, and JP-A-48-93672.

As the second undercoating layer there may be independently used the same polymer as used in the first undercoating layer. If necessary, the second undercoating layer may comprise a crosslinking agent, an inorganic particulate material, a surface active agent, a thickening agent, a dye, a preservative or the like incorporated therein.

In the single-layer method, a method is often used which comprises allowing the support to swell, and then mixing the support with the undercoating polymer at the interface thereof to provide a good adhesivity. Examples of the undercoating polymer employable herein include water-soluble polymers such as gelatin, gelatin derivative, casein, agar-agar, sodium alginate, starch, polyvinyl alcohol, polyacrylic acid copolymer and maleic anhydride copolymer, cellulose esters such as carboxymethyl cellulose and hydroxyethyl cellulose, and latex polymers such as vinyl chloride-containing copolymer, vinylidene chloride-containing copolymer, acrylic acid ester-containing copolymer, vinyl acetate-containing copolymer and vinyl acetate-containing copolymer. As gelatin there may be used any gelatin generally known in the art such as lime-treated gelatin, acid-treated gelatin, enzymatically treated gelatin, gelatin derivative and modified gelatin. Particularly preferred among these gelatin products are lime-treated gelatin and acid-treated gelatin.

Only the first layer of the double-layer method may be used.

It is important in the single-layer method and double-layer method that drying is effected at a temperature of from not lower than 50° C. to not higher than 150° C.

Prior to undercoating, surface treatment may be effected to improve adhesivity to advantage. Preferred examples of surface treatment include glow discharge treatment, corona treatment, irradiation with ultraviolet rays, and flame treating. Some formulations of the photosensitive emulsion layer or back layer can provide necessary adhesivity merely after surface treatment. In this case, undercoating is not necessarily required.

The glow discharge treatment can be carried out by any method as described in JP-B-35-7578, JP-B-36-10336, JP-B-45-22004, JP-B-45-22005, JP-B-24040, JP-B-46-43480, JP-A-53-129262, U.S. Pat. Nos. 3,057,792, 3,057,795, 3,179,482, 3,288,638, 3,309,299, 3,424,735, 3,462,335, 3,475,307, 3,761,299 and 4,072,769, and British Patent Nos. 891,469 and 997,093.

In accordance with the foregoing glow discharge treatment, the best adhesion effect can be exerted even in the case where water vapor is introduced into the atmosphere. The water vapor partial pressure is preferably from not less than 10% to not more than 100%, more preferably from not less than 40% to not more than 90%. If the water vapor partial pressure is too small, it is made difficult to obtain a sufficient adhesivity. The gas other than water vapor is air composed of oxygen, nitrogen, etc.

Further, if the support to be surface-treated is subjected to glow discharge treatment while being heated, improved adhesivity can be provided in a short period of time to advantage. The pre-heating temperature is preferably from not lower than 50° C. to not higher than Tg (glass transition temperature), more preferably from not lower than 60° C. to not higher than Tg, even more preferably from not lower than 70° C. to not higher than Tg. If the support is pre-heated at a temperature as high as higher than Tg, the resulting adhesivity is deteriorated.

The degree of vacuum during glow discharge treatment is preferably from 0.005 to 20 Torr, more preferably from 0.02 to 2 Torr. The voltage during glow discharge treatment is preferably between 500 V and 5,000 V, more preferably between 500 V and 3,000 V. The discharge frequency used is from dc to thousands of MHz, preferably from 50 Hz to 20 MHz, more preferably from 1 KHz to 1 MHz, as in the prior art technique. The discharge intensity is preferably from 0.01 KV·A·min/m$^2$ to 5 KV·A·min/m$^2$, more preferably from 0.15 KV·A·min/M$^2$ to 1 KV·A·min/m$^2$, to provide desired adhesivity.

The corona discharge treatment is a well-known method and can be accomplished by any known method as disclosed in JP-B-48-5043, JP-B-47-51905, JP-A-47-28067, JP-A-49-83767, JP-A-51-41770, and JP-A-51-131576. The discharge frequency is from 50 Hz to 5,000 KHz, preferably 5 KHz to hundreds of KHz. The intensity at which the object is treated is from 0.001 KV·A·min/m$^2$ to 5 KV·A·min/m$^2$, preferably from 0.01 KV·A·min/m$^2$ to 1 KV·A·min/m$^2$. The gap clearance between the electrode and the dielectric roll is from 0.5 to 2.5 mm, preferably from 1.0 to 2.0 mm.

The ultraviolet treatment is preferably carried out by any method as described in JP-B-43-2603, JP-B-43-2604 and JP-B-45-3828. The mercury vapor lamp to be used may be a high pressure mercury vapor lamp or low pressure mercury vapor lamp made of quartz tube which emits ultraviolet rays preferably having a wavelength of from 180 nm to 380 nm.

Referring to method for irradiation with ultraviolet rays, if a high pressure mercury vapor lamp which emits ultraviolet rays having a main wavelength of 365 nm is used, the exposed dose is preferably from 20 to 10,000 (mJ/cm$^2$), more preferably from 50 to 2,000 (mJ/cm$^2$). If a low pressure mercury vapor lamp which emits ultraviolet rays having a main wavelength of 254 nm is used, the exposed dose is preferably from 100 to 10,000 (mJ/cm$^2$), more preferably from 200 to 1,500 (mJ/cm$^2$).

For the flame treating, either natural gas or liquefied propane gas may be used. In practice, however, the mixing ratio to air is important. The mixing ratio of propane gas, if used, to air is preferably from 1/14 to 1/22, more preferably from 1/16 to 1/19. The mixing ratio of natural gas, if used, to air is preferably from 1/6 to 1/10, more preferably from 1/7 to 1/9.

The flame treating may be effected at 1 to 50 Kcal/m$^2$, preferably at 3 to 30 Kcal/m$^2$. Further, if the distance between the tip of the inner flame of the burner and the support is not more than 4 cm, the flame treating can be carried out more effectively. As the treating apparatus there may be used a flame treating apparatus produced by KASUGA ELECTRIC WORKS LTD. The back-up roll for supporting the support during flame treating may be a hollow roll through which cooling water flows to cool so that the treatment can be always carried out at a constant temperature.

The interlayer and protective layer in the present invention may be arbitrarily made of high molecular compounds or polymers which are normally used as binder. In general, colorless transparent or semi-transparent polymers are used.

Natural or semi-synthetic polymers (e.g., gelatin, gum arabic, hyroxyethyl cellulose, cellulose ester, casein, starch) may be used. Alternatively, the following synthetic polymers may be used.

Examples of the synthetic polymers include polyvinyl alcohol, polyvinyl pyrrolidone, polyacrylic acid, polymethyl methacrylate, polyvinyl chloride, polymethacrylic acid, styrene/maleic anhydride copolymer, styrene/acrylonitrile copolymer, styrene/butadiene copolymer, polyvinyl acetal (e.g., polyvinyl formal, polyvinyl butyral), polyester, polyurethane, phenoxy resin, polyvinylidene chloride, polyepoxide, polycarbonate, polyvinyl acetate, and polyamide. Hydrophobic polymers are preferred to hydrophilic polymers. Thus, preferred among these synthetic polymers are styrene/acrylonitrile copolymer, styrene/butadiene copolymer, polyvinyl acetal, polyester, polyurethane, cellulose acetate butyrate, polyacrylic acid, polymethyl methacrylate, polyvinyl chloride, and polyurethane. Particularly preferred among these synthetic polymers are styrene/butadiene copolymer and polyvinyl acetal.

The binder is used dissolved or emulsified in the solvent (water or organic solvent) for the coating solution of the photosensitive layer or light-insensitive layer. If the binder is emulsified in the coating solution, an emulsion of the binder may be mixed with the coating solution.

The amount of the binder to be incorporated in the layer containing a dye or pigment is preferably adjusted such that the coated amount of the dye or pigment is from 0.01 to 60% by weight of that of the binder. The coated amount of the dye or pigment is more preferably from 0.05 to 40% by weight, most preferably from 0.1 to 20% by weight.

Examples of the support to be used in the photothemographic material include paper, polyethylene-coated paper, polypropylene-coated paper, parchment, cloth, metal (e.g., aluminum, copper, magnesium, zinc) sheet or thin film, glass, and glass and plastic film coated with metal (e.g., chromium alloy, steel, silver, gold, platinum).

As the support for the photothermographic material of the present invention there may be preferably used a plastic film. Examples of plastic to be used as support include polyalkyl methacrylate (e.g., polymethyl methacrylate), polyester (e.g., polyethylene terephthalate: PET), polyvinyl acetal, polyamide (e.g., nylon), and cellulose ester (e.g., cellulose nitrate, cellulose acetate, cellulose acetate propionate, cellulose acetate butyrate).

The support may be coated with a polymer. Examples of such a polymer include polyvinylidene chloride, acrylic acid-based polymer (e.g., polyacrylonitrile, methyl acrylate), polymer of unsaturated dicarboxylic acid (e.g., itaconic acid, acrylic acid), carboxymethyl cellulose, and polyacrylamide. Copolymers may be used. The support may be provided with an undercoating layer comprising a polymer instead of being coated with a polymer.

The photothermographic material according to the present invention is preferably of mono-sheet type (type which can form an image the photothermographic material itself rather than on other sheets such as image-receiving material).

The photothermographic material according to the present invention preferably comprises a photosensitive silver halide, an organic silver salt, a reducing agent and a binder incorporated therein. It comprises a photosensitive layer containing a photosensitive silver halide (photocatalyst in a catalytically active amount) and a reducing agent and a light-insensitive layer. The photosensitive layer further comprises a binder (normally a synthetic polymer) and an organic silver salt (reducible silver source) incorporated therein. The photosensitive layer preferably comprises a hydrazine compound (super hard gradation enhancement agent) or toning agent (for controlling tone of silver) incorporated therein. A plurality of photosensitive layers maybe provided. For example, for the purpose of adjusting gradation, a high sensitivity photosensitive layer and a low sensitivity photosensitive layer may be provided in the photothermographic material. Referring to the order of arrangement of the high sensitivity photosensitive layer and the low sensitivity photosensitive layer, the low sensitivity photosensitive layer may be disposed on the lower side (on the support side) or vice versa.

As the silver halide there may be used any of silver bromide, silver iodide, silver chloride, silver bromochloride, silver bromoiodide and silver bromochloroiodide. The particle size of the silver halide is preferably from not less than 0.01 $\mu$m to not more than 0.08 $\mu$m, more preferably from not less than 0.01 $\mu$m to not more than 0.05 $\mu$m, as calculated in terms of average diameter of sphere having the same volume.

The amount of silver halide to be added is preferably from 0.03 to 0.6 g/m$^2$, more preferably from 0.05 to 0.4 g/m$^2$, most preferably from 0.1 to 0.4 g/m$^2$, as calculated in terms of coated amount per m$^2$ of the photographic light-sensitive material.

The silver halide may be prepared by the reaction of silver nitrate as a silver halide emulsion with a soluble halogen salt. Alternatively, the silver halide may be prepared by reacting a silver soap with halogen ions to convert the soap moiety of the silver soap to halide. Alternatively, halogen ions may be added during the formation of silver soap. In the present invention, as the foregoing silver halide emulsion there is preferably used one prepared by the reaction of silver nitrate with a soluble halogen salt.

The silver halide to be used in the present invention is preferably subjected to spectral sensitization. Spectrally-sensitized dyes are described in JP-A-60-140335, JP-A-63-159841, JP-A-63-231437, JP-A-63-259651, JP-A-63-304242, JP-A-63-15245, and U.S. Pat. Nos. 4,639,414, 4,740,455, 4,741,966, 4,751,175 and 4,835,096.

Preferred examples of the reducing agent employable herein include phenidone, hydroquinone, catechol, and hindered phenol. Reducing agents are described in U.S. Pat. Nos. 3,770,448, 3,773,512, 3,593,863 and 4,460,681, and Research Disclosure Nos. 17029 and 29963.

Examples of the reducing agent employable herein include aminohydroxycycloalkenone compounds (e.g., 2-hydroxy-piperidino-2-cyclohexenone), N-hydroxyurea derivatives (e.g., N-p-methylphenyl-N-hydroxyurea), aldehyde or ketone hydrazones (e.g., anthracenaldehydephenyl hydrazone), phosphor-amide phenols, phosphor-amidanilines, polyhydroxybenzenes (e.g., hydroquinone, t-butyl-hydroquinone, isopropyl hydroquinone, 2,5-dihydroxy-phenylmethylsulfone), sulfohydroxamic acids (e.g., benzenesulfohydroxamic acid), sulfonamidanilines (e.g., 4-(N-methanesulfonamide)aniline), 2-tetrazolylthiohydroquinones (e.g., 2-methyl-5-(1-phenyl-5-tetrazolylthio)hydroquinone), tetrahydroquinoxalines (e.g., 1,2,3,4-tetrahydroquinoxaline), amidoxins, combination of azines (e.g., aliphatic carboxylic acid aryl hydrazides) and ascorbic acid, combination of polyhydroxybenzene and hydroxylamine, reductone, hydrazine, hydroxamic acids, combination of azines and sulfonamidephenols, $\alpha$-cyanophenylacetic acid derivative, combination of bis-$\beta$-naphthol and 1,3-dihydroxybenzene derivative, 5-pyrazolones, sulfonamidephenols, 2-phenylinedan-1,3-dion, chroman, 1,4-dihydroxypyridines (e.g., 2,6-dimethoxy-3,5-dicarboethoxy-1,4-dihydropyridine), bisphenols (e.g., bis(2-hydroxy-3-t-butyl-5-methylphenyl) methane, bis(6-hydroxy-m-tri)mesytol, 2,2-bis(4-hydroxy-3-methylphenyl)propane, 4,4-ethylidene-bis (2-t-butyl-6-methyl)phenol), ultraviolet-sensitive ascorbic acid derivatives, and 3-pyrazolidones.

Esters of aminoreductones (e.g., piperidinohexose reductone monoacetate) which act as precursor of reducing agent may be used as reducing agents.

A particularly preferred example of reducing agents is hindered phenol.

The added amount of the reducing agent is preferably from 0.01 to 5.0 g/m$^2$, more preferably from 0.1 to 3.0 g/m$^2$.

The photosensitive layer and light-insensitive layer have already been described with reference to interlayer and protective layer. The photosensitive layer and light-insensitive layer preferably comprise a binder incorporated therein. As such a binder there may be normally used a colorless transparent or semi-transparent polymer. Natural or semi-synthetic polymers (e.g., gelatin, gum arabic, hydroxyethyl cellulose, cellulose ester, casein, starch) maybe used. However, synthetic polymers are preferred to natural or semi-synthetic polymers taking heat resistance into account. Nevertheless, cellulose esters (e.g., acetate, cellulose acetate butyrate), even if they are semi-synthetic polymers, exhibit a relatively high heat resistance and thus can be preferably used binder for photothermographic material.

Examples of the synthetic polymer include polyvinyl alcohol, polyvinyl pyrrolidone, polyacrylic acid, polymethyl methacrylate, polyvinyl chloride, polymethacrylic acid, styrene/maleic anhydride copolymer, styrene/acrylonitrile copolymer, styrene/butadiene copolymer, polyvinyl acetal (e.g., polyvinyl formal, polyvinyl butyral), polyester, polyurethane, phenoxy resin, polyvinylidene chloride, polyepoxide, polycarbonate, polyvinyl acetate, and polyamide.

The binder is used dissolved or emulsified in the solvent (water or organic solvent) for the coating solution of the photosensitive layer or light-insensitive layer. If the binder is emulsified in the coating solution, an emulsion of the binder may be mixed with the coating solution.

The amount of the binder to be incorporated in the layer containing a pigment is preferably adjusted such that the coated amount of the pigment is from 0.01 to 60% by weight of that of the binder. The coated amount of the pigment is more preferably from 0.05 to 40% by weight, most preferably from 0.1 to 20% by weight.

The photosensitive layer or light-insensitive layer preferably further comprises an organic silver salt incorporated therein. The organic acid constituting the silver salt is preferably a long-chain aliphatic acid. The number of carbon atoms contained in the aliphatic acid is preferably from 10 to 30, more preferably from 15 to 25. An organic silver salt complex may be used. The complex preferably contains ligands such that the total stability constant against silver ion is from 4.0 to 10.0. Organic silver salts are described in Research Disclosure Nos. 17029 and 29963.

Examples of organic silver salts include silver salt of aliphatic acid (e.g., gallic acid, oxalic acid, behenic acid, stearic acid, palmitic acid, lauric acid), silver salt of carboxyalkylthiourea (e.g., 1-(3-carboxypropyl)thiourea, 1-(3-carboxypropyl)-3,3-dimethylthiourea), silver complex of product of polymer reaction of aldehyde (e.g., formaldehyde, acetaldehyde, butylaldehyde) with hydroxy-substituted aromatic carboxylic acid, silver salt of aromatic carboxylic acid (e.g., salicylic acid, benzoic acid, 3,5-dihydroxybenzoic acid, 5,5-thiodisalicylic acid), silver salt or silver complex of thioenes (e.g., 3-(2-carboxyethyl)-4-hydroxymethyl-4-thiazoline-2-thioene, 3-carboxymethyl-4-thiazoline-2-thioene), silver salt or silver complex of nitrogen acid (e.g., imidazole, pyrazole, urazole, 1,2,4-thiazole, 1H-tetrazole, 3-amino-5-benzylthio-1,2,4-triazole, benzotriazole), silver salt of saccharine, silver salt of 5-chlorosalicylaldoxim, and silver salt of mercaptide. Silver behenate is most preferred. The organic silver salt is preferably used in an amount of from not less than 0.05 g/m$^2$ to not more than 3 g/m$^2$, more preferably from not less than 0.3 g/m$^2$ to not more than 2 g/m$^2$ as calculated in terms of silver.

The photosensitive layer or light-insensitive layer preferably further comprises a super hard gradation enhancement agent incorporated therein. If the photothermographic material is used in the art of printing photography, the reproduction of continuous gradation image or line original by dot is important. The use of a super hard gradation enhancement agent makes it possible to improve the reproducibility of dot image or line original. As such a super hard gradation enhancement agent there may be used a hydrazine compound, quaternary ammonium compound or acrylonitrile compound (as disclosed in U.S. Pat. No. 5,545,515). A hydrazine compound is particularly preferred.

A hydrazine compound comprises hydrazine ($H_2N$—$NH_2$) and a compound obtained by substituting at least one of the hydrogen atoms in hydrazine by substituents such as aliphatic group, aromatic group and heterocyclic group. The substituents may be bonded to the nitrogen atom in hydrazine directly or via a connecting group. Examples of the connecting group include—CO—, —CS—, —$SO_2$—, —POR— (in which R represents an aliphatic group, aromatic group or heterocyclic group), —CNH—, and combination thereof.

Hydrazine compounds are described in U.S. Pat. Nos. 5,464,738, 5,496,695, 5,512,411 and 5,536,622, JP-B-6-77138, JP-B-6-93082, JP-A-6-230497, JP-A-6-289520, JP-A-6-313951, JP-A-7-5610, JP-A-7-77783, and JP-A-7-104426.

The hydrazine compound may be added to the coating solution of the photosensitive layer in the form of solution in a proper organic solvent. Examples of the organic solvent employable herein include alcohol such as methanol, ethanol, propanol and fluorinated alcohol, ketone such as acetone and methyl ethyl ketone, dimethylformamide, dimethylsulfoxide, and methyl cellosolve. Alternatively, the hydrazine compound may be emulsified in the coating solution in the form of solution in an oily (auxiliary) solvent. Examples of the oily (auxiliary) solvent employable herein include dibutyl phthalate, tricresyl phosphate, glyceryl triacetate, diethyl phthalate, ethyl acetate, and cyclohexanone. Further, the hydrazine compound may be added to the coating solution in the form of solid dispersion. The dispersion of the hydrazine compound can be accomplished by means of a known dispersing apparatus such as ball mill, colloid mill, Manton Gaulin, microfluidizer and ultrasonic dispersing apparatus.

The amount of the super hard gradation enhancement agent to be added is preferably from $1\times10^{-6}$ to $1\times10^{-2}$ mols, more preferably from $1\times10^{-5}$ to $1\times10^{-3}$ mols, most preferably from $2\times10^{-5}$ to $5\times10^{-3}$ mols, based on mol of silver halide.

A hard gradation accelerator may be added in addition to the super hard gradation enhancement agent. Examples of the hard gradation accelerator employable herein include amine compounds (as described in U.S. Pat. No. 5,545,505), hydroxamic acids (as described in U.S. Pat. No. 5,545,507), acrylonitriles (as described in U.S. Pat. No. 5,545,507), and hydrazine compounds (as described in U.S. Pat. No. 5,558,983).

The photosensitive layer or light-insensitive layer preferably further comprises a toning agent incorporated therein. Toning agents are described in Research Disclosure No. 17029.

Examples of the toning agent employable herein include imides (e.g., phthalimide), cyclic imides (e.g., succinimide), pyrazoline-5-ons (e.g., 3-phenyl-2-pyrazoline-5-on, 1-phenylurazole), quinazolinones (e.g., quinazoline, 2,4-thiazolidion), naphthalimides (e.g., N-hydroxy-1,8-naphthalimide), cobalt complexes (e.g., hexamine trifluoroacetate of cobalt), mercaptans (e.g., 3-mercapto-1,2,4-triazole), N-(aminomethyl)aryldicarboxylimides (e.g., N-(dimethylaminomethyl)phthalimide), blocked pyrazoles (e.g., N,N'-hexamethylene-1-carbamoyl-3,5-dimethylpyrazole), combination of isothiuronium derivative (e.g., 1,8-(3,6-dioxaoctan)bis(isothiuroniumtrifluoroacetate) and light bleach (e.g., 2-(tribromomethylsulfonyl)benzothiazole), melocyanine dyes (e.g., 3-ethyl-5-((3-ethyl-2-benzothiazolinylidene)-1-methylethylidene)-2-thio-2, 4-oxazolizinedione), phthalazinone compounds and metal salts thereof (e.g., phthalazinone, 4-( 1-naphthyl)phthalazinone, 6-chlorophthalazinone, 5,7-dimethyloxypthalazinone, 2,3-dihydro-1,4-phthalazinedion, 8-methylphthalazione), combination of phthalazinone compound and sulfinic acid derivative (e.g., sodium benzenesulfinate), combination of phthalazinone compound and sulfonic acid derivative (e.g., sodium p-toluenesulfonate), phthalazine and derivative thereof (e.g., phthalazine, 6-isopropylphthalazine, 6-methylphthalazine), combination of phthalazines and phthalic acid, combination of phthalazine or phthalazine adduct and dicarboxylic acid (preferably o-phenylenic acid) or anhydride thereof (e.g., maleic anhydride, phthalic acid, 2,3-naphthalenedicarboxylic acid, phthalic anhydride, 4-methylphthalic acid, 4-nitrophthalic acid, tetrachlorophthalic anhydride), quinazolinedions, benzoxazine, naphthoxazine derivatives, benzoxazine-2,4-dions (e.g., 1,3-benzoxazine-2,4-dion), pyrimidines, asymmetric triazines (e.g., 3,6-dimercapto-1,4-diphenyl-1H, 4H-2,3a, 5,6a-tetrazapentalene). Phthalazine and derivatives thereof are particularly preferred.

The toning agent is preferably incorporated in the image-forming layer in an amount of from 0.1 to 50 mol-%, more preferably from 0.5 to 20 mol-% per mol of silver.

The photosensitive layer or light-insensitive layer (preferably photosensitive layer) may comprise a fog inhibitor (antifoggant) incorporated therein. As such a fog inhibitor there may be preferably used a non-mercury compound (as described in U.S. Pat. Nos. 3,874,946, 4,546,075, 4,452,885, 4,756,999 and 5,028,523, British Patent Application Nos. 92221383.4, 9300147.7 and 9311790.1, JP-A-59-57234) rather than mercury compound (as described in U.S. Pat. No. 3,589,903).

A particularly preferred fog inhibitor is a polyhalogen compound. An even more particularly preferred fog inhibitor is a heterocyclic compound having a methyl group substituted by halogen (F, Cl, Br, I).

Examples of the polyhalogen compound employable herein include compounds as described in JP-A-50-119624, JP-A-50-120328, JP-A-51-121332, JP-A-54-58022, JP-A-56-70543, JP-A-56-99335, JP-A-59-90842, JP-A-61-129642, JP-A-62-129845, JP-A-6-208191, JP-A-7-5621, JP-A-7-2781, JP-A-8-15809, U.S. Pat. Nos. 5,340,712, 5,369,000 and 5,464,737. In particular, a polyhalogen compound represented by the following formula (1) is preferred.

(1)

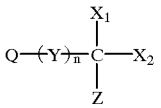

wherein Q represents an alkyl, aryl or heterocyclic group; $X_1$ and $X_2$ each represents a halogen atom; Z represents a hydrogen atom or electron withdrawing group; Y represents —C(=O)—, —SO— or —$SO_2$; and n represents an integer of 0 or 1.

The formula (1) will be further described hereinafter. Q represents an alkyl, aryl or heterocyclic group. The aryl represented by Q may be monocyclic or condensed, preferably a $C_{6-30}$ monocyclic or bicyclic aryl group (e.g., phenyl, naphthyl), more preferably phenyl group or naphthalyl group, even more preferably phenyl group.

The heterocyclic group represented by Q is a 3- to 10-membered saturated or unsaturated heterocyclic group containing at least one of N, O and S atoms. The heterocyclic group may be monocyclic or may form a condensed ring with other rings.

The heterocyclic group is preferably a 5- or 6-membered unsaturated heterocyclic group which may contain a condensed ring, more preferably a 5- or 6-membered aromatic heterocyclic group which may contain a condensed ring, even more preferably a 5- or 6-membered aromatic heterocyclic group containing nitrogen atom, particularly a 5- or 6-membered aromatic heterocyclic group containing from 1 to 4 nitrogen atoms which may contain a condensed ring.

Specific examples of the heterocycle in the heterocyclic group include pyrrolidine, piperidine, piperazine, morpholine, thiophene, furan, pyrrole, imidazole, pyrazole, pyridine, pyrimidine, pyrazine, pyridazine, triazole, triazine, indole, indazole, purine, thiadiazole, oxadiazole, quinoline, phthalazine, naphthylidine, quinoxaline, quinazoline, cinnoline, pteridine, acridine, phenanthroline, phenazin, tetrazole, thiazole, oxazole, benzimidazole, benzoxazole, benzthiazole, benzselenazole, indolenine, and tetrazaindene. Preferred among these heterocycles are imidazole, pyrazole, pyridine, pyrimidine, pyrazine, pyridazine, triazole, triazine, indole, indazole, purine, thiadiazole, oxadiazole, quinoline, phthalazine, naphthylidine, quinoxaline, quinazoline, cinnoline, pteridine, acridine, phenanthroline, phenazin, tetrazole, thiazole, oxazole, benzimidazole, benzoxazole, benzthiazole, indolenine, and tetrazaindene. Preferred among these heterocycles are imidazole, pyridine, pyrimidine, pyrazine, pyridazine, triazole, triazine, thiadiazole, oxadiazole, quinoline, phthalazine, naphthylidine, quinoxaline, quinazoline, cinnoline, tetrazole, thiazole, oxazole, benzimidazole, benzoxazole, benzthiazole, and tetrazaindene. Preferred among these heterocycles are imidazole, pyridine, pyrimidine, pyridazine, triazole, triazine, thiadiazole, quinoline, phthalazine, naphthylidine, quinoxaline, quinazoline, cinnoline, tetrazole, thiazole, benzimidazole, and benzthiazole. Particularly preferred among these heterocycles are pyridine, thiadiazole, quinoline, and benzthiazole.

The aryl group or heterocycle represented by Q may have substituents other than —$(Y)_n$—$CZ(X_1)(X_2)$. Examples of such substituents include alkyl group (preferably $C_{1-20}$, more preferably $C_{1-12}$, particularly $C_{1-8}$alkyl group such as methyl, ethyl, n-propyl, iso-propyl, n-butyl, iso-butyl, tert-butyl, n-octyl, n-decyl, n-hexadecyl, cyclopropyl, cyclopentyl and cyclohexyl), alkenyl group (preferably $C_{2-20}$, more preferably $C_{2-12}$, particularly $C_{2-8}$ alkenyl group such as vinyl, allyl, 2-butenyl and 3-pentenyl), alkinyl group (preferably $C_{2-20}$, more preferably $C_{2-12}$, particularly $C_{2-8}$ alkinyl group such as propargyl and 3-pentinyl), aryl group (preferably $C_{6-30}$, more preferably $C_{6-20}$, particularly $C_{6-12}$ aryl group such as phenyl, p-methylphenyl and naphthyl), amino group (preferably $C_{0-20}$, more preferably $C_{0-10}$, particularly $C_{0-6}$ amino group such as amino, methylamino, dimethylamino, diethylamino and dibenzylamino), alkoxyl group (preferably $C_{1-20}$, more preferably $C_{1-12}$, particularly $C_{1-8}$ alkoxyl group such as methoxy, ethoxy and butoxy), aryloxy group (preferably $C_{6-20}$, more preferably $C_{6-16}$, particularly $C_{6-12}$ aryloxy group such as phenyloxy and 2-naphthyloxy), acyl group (preferably $C_{1-20}$, more preferably $C_{1-16}$, particularly $C_{1-12}$ acyl group such as acetyl, benzoyl, formyl and pivaloyl), alkoxycarbonyl group (preferably $C_{2-20}$, more preferably $C_{2-16}$, particularly $C_{2-12}$ alkoxycarbonyl group such as methoxycarbonyl and ethoxy carbonyl), aryloxycarbonyl group (preferably $C_{7-20}$, more preferably $C_{7-16}$, particularly $C_{7-10}$ aryloxycarbonyl group such as phenyloxycarbonyl), acyloxy group (preferably $C_{2-20}$, more preferably $C_{2-16}$, particularly $C_{2-10}$ acyloxy group such as acetoxy and benzoyloxy), acylamino group (preferably $C_{2-20}$, more preferably $C_{2-16}$, particularly $C_{2-10}$ acylamino group such as acetylamino and benzoylamino), alkoxycarbonylamino group (preferably $C_{2-20}$, more preferably $C_{2-16}$, particularly $C_{2-12}$ alkoxycarbonylamino group such as methoxycarbonylamino), aryloxycarbonylamino group (preferably $C_{7-20}$, more preferably $C_{7-16}$, particularly $C_{7-12}$ aryloxycarbonylamino group such as phenyloxycarbonylamino), sulfonylamino group (preferably $C_{1-20}$, more preferably $C_{1-16}$, particularly $C_{1-12}$ sulfonylamino group such as methanesulfonylamino and benzenesulfonylamino), sulfamoyl group (preferably $C_{0-20}$, more preferably $C_{0-16}$, particularly $C_{0-12}$ sulfamoyl group such as sulfamoyl, methysulfamoyl, dimethylsulfamoyl and phenylsulfamoyl), carbamoyl group (preferably $C_{1-20}$, more preferably $C_{1-16}$, particularly $C_{1-12}$ carbamoyl group such as carbamoyl, methylcarbamoyl, diethylcarbamoyl and phenylcarbamoyl), alkylthio group (preferably $C_{1-20}$, more preferably $C_{1-16}$, particularly $C_{1-12}$ alkylthio group such as methylthio and ethylthio), arylthio group (preferably $C_{6-20}$, more preferably $C_{6-16}$, particularly $C_{6-12}$ arylthio group such as phenylthio), sulfonyl group (preferably $C_{1-20}$, more preferably $C_{1-16}$, particularly $C_{1-12}$ sulfonyl group such as mesyl, tosyl and phenylsulfonyl), sulfinyl group (preferably $C_{1-20}$, more preferably $C_{1-16}$, particularly $C_{1-12}$ sulfinyl group such as methanesulfinyl and benzenesulfinyl), ureide group (preferably $C_{1-20}$, more preferably $C_{1-16}$, particularly $C_{1-12}$ ureide group such as ureide, methylureide and phenylureide), phosphoric acid amide group (preferably $C_{1-20}$, more preferably $C_{1-16}$, particularly $C_{1-12}$ phosphoric acid amide group such as diethylphosphoric acid amide and phenylphosphoric acid amide), hydroxyl group, mercapto group, halogen atom (e.g., fluorine, chlorine, bromine, iodine), cyano group, sulfo group, carboxyl group, nitro group, hydroxamic acid group, sulfino group, hydrazino group, and heterocyclic group (e.g., imidazolyl, pyridyl, furyl, piperidyl, morpholino). These substituents may be further substituted. If there are two or more of these substituents, they may be the same or different.

Preferred among these substituents are alkyl group, alkenyl group, aryl group, alkoxy group, aryloxy group, acyloxy group, acyl group, alkoxycarbonyl group, aryloxycarbonyl group, acyloxy group, acylamino group, alkoxycarbonylamino group, aryloxycarbonylamino group, sulfonylamino group, sulfamoyl group, carbamoyl group, sulfonyl group, ureide group, phosphoric acid amide group, halogen atom, cyano group, sulfo group, carboxyl group, nitro group, and heterocyclic group. Preferred among these substituents are alkyl group, aryl group, alkoxy group, aryloxy group, acyl group, acylamino group, alkoxycarbonyl amino group, aryloxycarbonylamino group, sulfonylamino group, sulfamoyl group, carbamoyl group, ureide group, phosphoric acid amide group, halogen atom, cyano group, nitro group, and heterocyclic group. Preferred among these substituents are alkyl group, aryl group, alkoxy group, aryloxy group, acyl group, acylamino group, sulfonylamino group, sulfamoyl group, carbamoyl group, halogen atom, cyano group, nitro group, and heterocyclic group. Particularly preferred among these substituents are alkyl group, aryl group, and halogen atom. The alkyl group represented by Q may be straight-chain, branched or cyclic. The alkyl group preferably has from 1 to 30 carbon atoms, more preferably from 1 to 15 carbon atoms. Examples of the alkyl group include methyl group, ethyl group, n-propyl group, isopropyl group, and tertiary octyl group.

The alkyl group represented by Q may have substituents other than $—(Y)_n—CZ(X_1)(X_2)$. As such substituents there may be used the same substituents as used for the heterocyclic or aryl group represented by Q. Preferred among these substituents are alkenyl group, aryl group, alkoxy group, aryloxy group, acyloxy group, acylamino group, alkoxycarbonylamino group, aryloxycarbonylamino group, sulfonylamino group, alkylthio group, arylthio group, ureide group, phosphoric acid amide group, hydroxyl group, halogen atom, and heterocyclic group. Preferred among these substituents are aryl group, alkoxy group, aryloxy group, acylamino group, alkoxycarbonylamino group, aryloxyarbonyl amino group, sulfonylamino group, ureide group, phosphoric acid amide group, and halogen atom. Particularly preferred among these substituents are aryl group, alkoxy group, aryloxy group, acylamino group, sulfonylamino group, ureide group, and phosphoric acid amide group.

These substituents may be further substituted. If there are two or more of these substituents, they may be the same or different.

Y represents —C(=O)—, —SO— or $—SO_2—$, preferably —C(=O)— or $—SO_2—$, more preferably $—SO_2—$.

The suffix n represents an integer of 0 or 1, preferably 1.

$X_1$ and $X_2$ each represents a halogen atom. The halogen atoms represented by $X_1$ and $X_2$ may be the same or different and each are fluorine, chlorine, bromine or iodine, preferably chlorine, bromine or iodine, more preferably chlorine or bromine, particularly bromine.

Z represents a hydrogen atom or electron withdrawing group. The electron withdrawing group represented by Z is preferably a substituent having a σp value of not less than 0.01, more preferably not less than 0.1. For the details of Hammett's substituent constant, reference can be made to Journal of Medicinal Chemistry, Vol. 16, No. 11, pp. 1207–1216, 1973. Examples of the electron withdrawing group represented by Z include halogen atom (fluorine atom (σp value: 0.06), chlorine atom (σp value: 0.23), bromine atom (σp value: 0.23), iodine atom (σp value: 0.18)), trihalomethyl group (tribromomethyl (σp value: 0.29), trichloromethyl group (σp value: 0.33), trifluoromethyl (σp value: 0.54), cyano group (σp value: 0.66), nitro group (σp value: 0.78), aliphaticaryl or heterocyclic sulfonyl group (e.g., methanesulfonyl (σpvalue: 0.72)), aliphatic aryl or heterocyclic acyl group (e.g., acetyl (σp value: 0.50), benzoyl (σp value: 0.43)), alkinyl group (e.g., C≡CH (σp value: 0.23)), aliphatic aryl or heterocyclic oxycarbonyl group (e.g., methoxycarbonyl (σp value: 0.45), phenoxycarbonyl (σp value: 0.44)), carbamoyl group (σp value: 0.36), and sulfamoyl group (σp value: 0.57).

Z is preferably an electron withdrawing group, more preferably a halogen atom, aliphatic aryl or heterocyclic sulfonyl group, aliphatic aryl or heterocyclic acyl group, aliphatic aryl or heterocyclic oxycarbonyl group, carbamoyl group or sulfamoyl group, particularly a halogen atom. Preferred among these halogen atoms are chlorine atom, bromine atom, and iodine atom. Preferred among these halogen atoms are chlorine atom and bromine atom. Particularly preferred among these halogen atoms is bromine atom.

Preferred among the compounds represented by the formula (1) are those represented by the following formula (1-a):

(1-a)

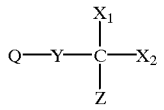

In the foregoing formula (1-a), Q and its preferred range are as defined in the formula (1). The substituents by which Q can be substituted are the same as those by which Q can be substituted in the formula (1). $X_1$, $X_2$, Y and Z and their preferred range are as defined in the formula (1).

Even more desirable among the compounds represented by the formula (1) are those represented by the foregoing formula (1-b):

(1-b)

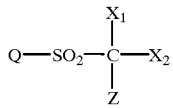

In the foregoing formula (1-b), Q and its preferred range are as defined in the formula (1). The substituents by which Q can be substituted are the same as those by which Q can be substituted in the formula (1). $X_1$, $X_2$ and Z and their preferred range are as defined in the formula (1).

Specific examples of the compound represented by the formula (1) will be given below, but the present invention should not be construed as being limited thereto.

II-1

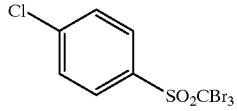

II-2

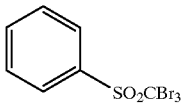

II-3

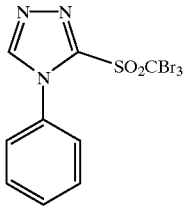

II-4

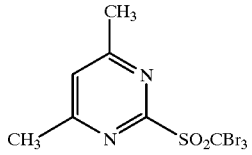

-continued

II-5

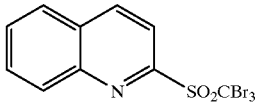

II-6

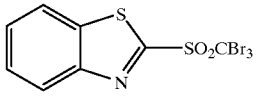

II-7

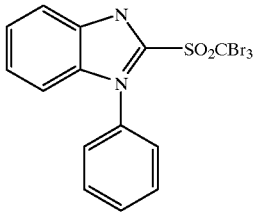

II-8

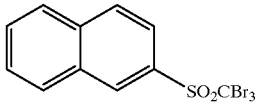

II-9

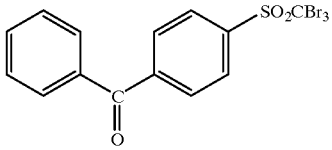

II-10

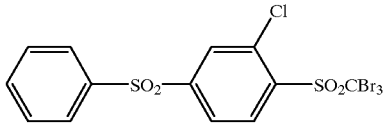

II-11

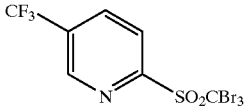

II-12

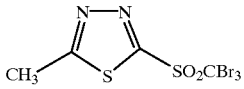

II-13

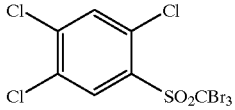

II-14

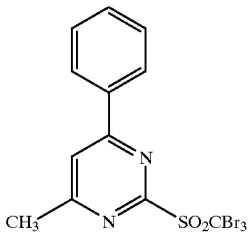

-continued
II-15
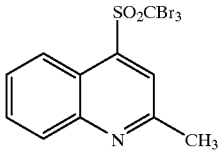
II-16
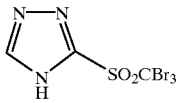
II-17
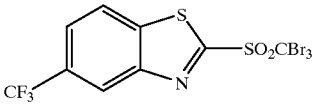
II-18
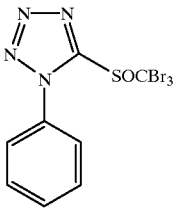
II-19
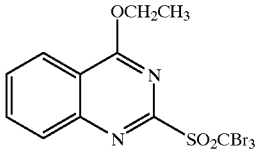
II-20
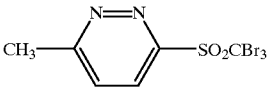
II-21
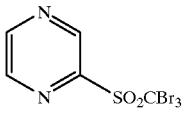
II-22
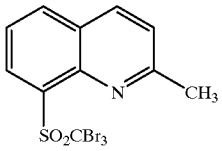
II-23
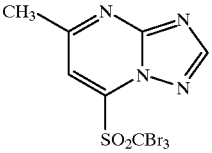
II-24
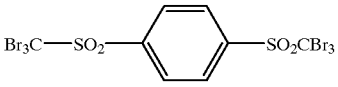
-continued
II-25
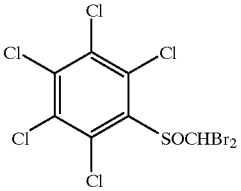
II-26
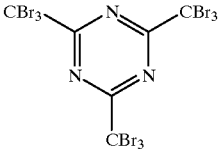
II-27
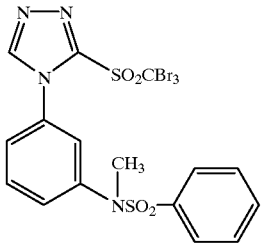
II-28
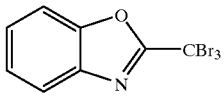
II-29
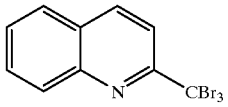
II-30
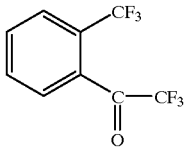
II-31
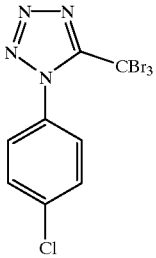
II-32
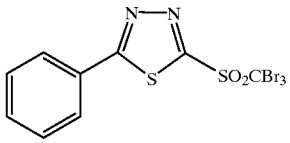

-continued

II-33

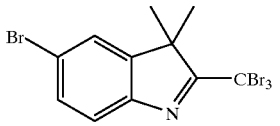

II-34

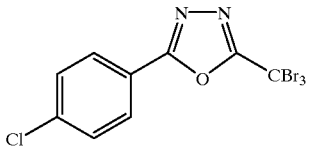

II-35

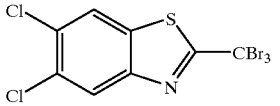

II-36

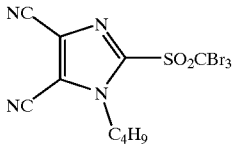

II-37

$CH_3(CH_2)_2CBr_2SO_2CBr_3$

II-38

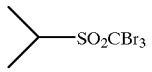

The synthesis of the compound of the present invention represented by the formula (1) wherein Y represents —SO— or —$SO_2$— can be accomplished by synthesizing an α-arylthio or heterocyclic thioacetic acid derivative from an aryl, or heterocyclic mercaptan and α-halogenoacetic acid derivative, or α-halogenoacetic acid ester derivative, and then oxidizing and brominating the acetic acid derivative. Alternatively, a method may be used which comprises oxidizing and brominating the corresponding sulfide derivative as described in JP-A-2-304059. Further, a method may be used which comprising halogenating the corresponding sulfone derivative as described in JP-A-2-264754.

The conversion to α-arylthio or heterocyclic thioacetic acid derivative can be accomplished by reacting the corresponding mercaptan compound with an α-halogenoacetic acid derivative or the like under basic conditions.

The simultaneous oxidation and halogenation of α-arylthio or heterocyclic thioacetic acid derivative can be accomplished by adding an α-arylthio, or heterocyclic thioacetic acid derivative, or its salt to a hypohalogenous acid or a basic aqueous solution of salt thereof so that they undergo reaction. Alternatively, it can be accomplished by converting an α-arylthio or heterocyclic thioacetic acid derivative to a sulfoxide or sulfonylacetic acid derivative with an oxidizing agent such as hydrogen peroxide, and then halogenating the sulfoxide or sulfonylacetic acid derivative.

As processes for the synthesis of alkyl, aryl or heterocyclic mercaptans to be used as starting material there have been known various processes described in "Shinjikken Kagaku Koza (New Course of Experimental Chemistry)", Maruzen, 14-III, Chapter 8, 8-1, "ORGANIC FUNCTIONAL GROUP PREPARATIONS", Sandler, Karo, ACADEMIC PRESS, New York and Rondon, I-Chapt. 18, and THE CHEMISTRY OF FUNCTIONAL GROUPS, Patail, JONE WILLY & SONS, "The Chemistry of the Thiol Group", Chapt 4. for alkyl and aryl mercaptan or "Comprehensive Heterocyclic Chemistry", Pergamaon Press, 1984, and Heterocyclic Compounds, John Wiley and Sons, Vol. 1–9, 1950–1967 for heterocyclic mercaptan.

The synthesis of the compound of the present invention represented by the formula (1) wherein Y represents —C(=O)— can be accomplished by synthesizing an acetophenone or carbonyl-substituted heterocycle derivative, and then α-halogenating the carbonyl compound. The α-halogenation of the carbonyl compound can be accomplished by the method described in "Shinjikken Kagaku Koza", Maruzen, 14-I, Chapter 2.

The synthesis of the compound of the present invention represented by the formula (1) wherein n is 0 can be accomplished by methylating toluene, xylene or a heterocyclic compound containing methyl group. The halogenation can be accomplished by the method described in "Shinjikken Kagaku Koza", Maruzen, 14-I, Chapter 2 as mentioned above.

The polyhalogen compound of the present invention may be added in the form of solid particle dispersion with a dispersing agent for the purpose of obtaining a particulate material free from agglomeration. The solid particle dispersion of the polyhalogen compound of the present invention can be accomplished by mechanically dispersing the polyhalogen compound in the presence of a dispersing aid using a known atomizer such as ball mill, oscillating ball mill, planetary ball mill, sand mill, colloid mill, jet mill and roller mill.

For the solid atomization of the polyhalogen compound of the present invention using a dispersing agent, synthetic anionic polymers such as polyacrylic acid, acrylic acid copolymer, maleic acid copolymer, maleic acid-monoester copolymer and acryloyl methyl propane-sulfonic acid copolymer, semi-synthetic anionic polymers such as carboxymethyl starch and carboxymethyl cellulose, anionic polymers such as alginic acid and pectinic acid, anionic surface active agents described in JP-A-52-92716 and WO88/04794, compounds described in Japanese Patent Application No. 7-350753, other known anionic, nonionic and cationic surface active agents, other known polymers such as polyvinyl alcohol, polyvinyl pyrrolidone, carboxymethyl cellulose, hydroxypropyl cellulose and hydroxypropylmethyl cellulose, and high molecular compounds occurring in natural world such as gelatin can be selectively used.

The dispersing aid is normally mixed with the polyhalogen compound of the present invention in the form of powder or wet cake before dispersion, and then fed into the dispersing apparatus in the form of slurry. Alternatively, the dispersing aid may be subjected to heat treatment or treatment with a solvent in admixture with the compound of the present invention to form a powder or wet cake. The dispersion material may be adjusted with a proper pH controller before or after or during dispersion to control the pH value thereof.

In addition to mechanical dispersion, the dispersion material may be controlled in pH so that it is coarsely dispersed in a solvent, and then subjected to pH change in the presence of a dispersing aid to undergo atomization. As the solvent to be used in coarse dispersion there may be used an organic solvent. In general, the organic solvent is removed after the termination of atomization.

The dispersion thus prepared may be stored with stirring or in a highly viscous form with a hydrophilic colloid (e.g., gelatinous form prepared with gelatin) for the purpose of inhibiting sedimentation of particles. For the purpose of inhibiting the propagation of bacteria or the like, a preservative may be incorporated in the dispersion.

The position in the photothermographic material of the present invention at which the polyhalogen compound of the present invention is incorporated is not limited. The polyhalogen compound of the present invention may be incorporated in the image-forming layer (photosensitive layer), protective layer or any other layers. In particular, the polyhalogen compound of the present invention is preferably incorporated in the same layer as the layer containing an organic silver salt or the containing a silver halide.

The polyhalogen compounds of the present invention may be used singly or in combination.

The polyhalogen compound of the present invention is preferably incorporated in the surface having an image-forming layer in an amount of from $1\times10^{-6}$ to 0.5 mol, more preferably from $1\times10^{-5}$ to $1\times10^{-1}$ mol per mol of silver.

The photothermographic material according to the present invention may further comprise a surface active agent, an oxidation inhibitor, a stabilizer, a plasticizer, an ultraviolet absorber or a coating aid incorporated therein. The various additives may be incorporated in either the photosensitive layer or the light-insensitive layer.

The photothermographic material which has been imagewise exposed to light is then heated to form an image thereon. This heat development allows the formation of a black silver image. For the imagewise exposure, a laser is preferably used. The heating temperature at which heat development is effected is preferably from 80° C. to 250° C., more preferably from 100° C. to 200° C. The heating time is normally from 1 second to 2 minutes.

The heat development process is preferably effected using a plate heater. The heat development process using a plate heater is disclosed in Japanese Patent Application No. 9-229684. This heat development process involves the use of a heat development apparatus in which a photothermographic material having a latent image formed therein is allowed to come in contact with a heating means at the heat development zone to obtain a visible image. The heating means is made of a plate heater. A plurality of hold-down rollers are disposed opposed to the plate heater along one surface of the plate heater. In this arrangement, the photothermographic material is passed through the gap between the hold-down rollers and the plate heater to undergo heat development.

The heat development zone in the heat development apparatus for effecting this heating process may be in a form as shown in FIG. 1.

As shown in FIG. 1, the photothermographic material which has been exposed to light is carried in the direction shown by the arrow, and then heated at the heat development zone 18 to undergo heat development that renders the latent image visible. In the present invention, the heat development zone 18 comprises a plate heater 120 and a plurality of hold-down rollers 122 arranged to the plate heater 120.

The plate heater 120 is a sheet-like heating member having a heating element such as nichrome wire incorporated flatwise therein and is kept at the development temperature of the photothermographic material. The plate heater 120 preferably has a fluororesin coated on or a fluororesin sheet attached to the surface thereof for the purpose of reducing the frictional resistance or abrasion resistance thereof.

When the photothermographic material is subjected to heat development, the resulting heat causes volatile components to be evaporated. This causes the photothermographic material to be separated from the plate heater 120 and thus can make the contact of the photothermographic material with the plate heater 120 ununiform. In order to allow the vapor to escape, it is preferred that the surface of the plate heater 120 is finely roughened.

In order to compensate for the temperature drop at the both ends of the plate heater 120 due to heat dissipation, a temperature gradient is preferably provided such that the plate heater 120 shows a higher temperature at both ends thereof than at the other portions.

The hold-down rollers 122 are arranged in contact with one surface of the plate heater 120 or with a clearance of not more than the thickness of the photothermograhic material over the length of the plate heater 120 in the carrying direction at a predetermined pitch. These hold-down rollers 122 and the plate heater 120 together form a passage for photothermographic material. By predetermining the clearance of the photothermographic material passage to not more than the thickness of the photothermographic material, the photothermographic material can be prevented from being buckled. The photothermographic material passage has a pair of feed rollers 126 for feeding the photothermographic material into the heat development zone 18 in the direction shown by the arrow at one end thereof and a pair of discharge rollers 128 for discharging the photothermographic material thus heat-developed in the direction shown by the arrow at the other.

An insulating cover 125 for heat insulation is preferably provided on the side of the hold-down rollers 122 opposite the plate heater 120 as shown in FIG. 1.

When the forward end of the photothermographic material hits one of the hold-down rollers 122 during conveyance, the photothermographic material stops momentarily. If the hold-down rollers 122 are arranged apart at an equal pitch, the photothermographic material is stopped at the same point every roller 122. Thus, the photothermographic material is pressed at the same point under the plate heater 120 for a prolonged period of time. As a result, the photothermographic material is liable to crosswise striped uneven development. In order to eliminate this defect, the hold-down rollers 122 are preferably pitched unevenly.

Figure 2:
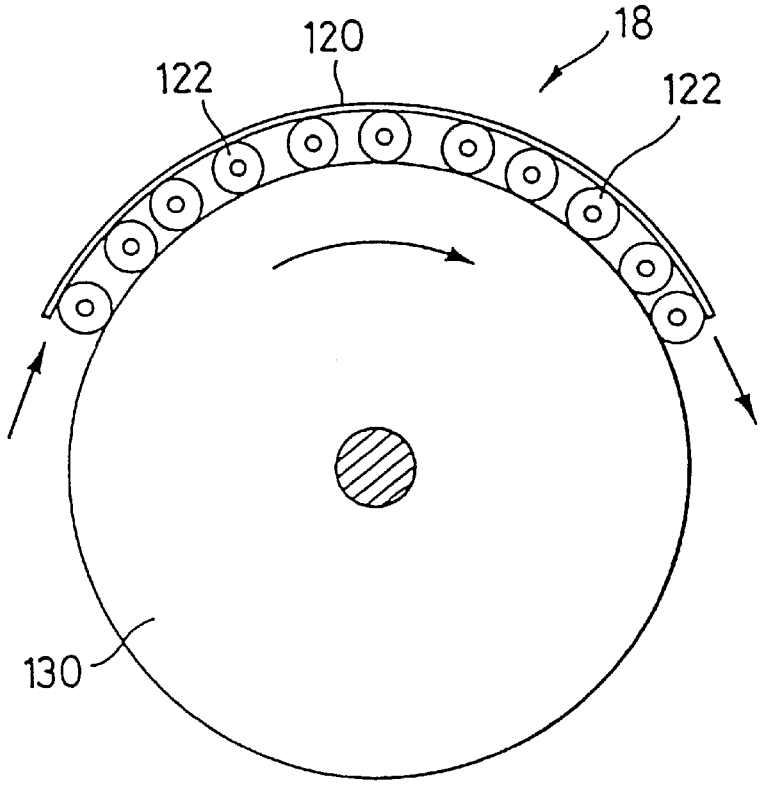
FIG. 2 is a schematic diagram illustrating another example of the heat development zone in the heat development apparatus used in the present invention, wherein the reference numeral 18 indicates a heat development zone, the reference numeral 120 indicates a plate heater, the reference numeral 122 indicates a hold-down roller, and the reference numeral 130 indicates a driving roller.

As shown in FIG. 2, the heat development zone 18 may comprise a driving roller 130 the periphery of which is the same as the envelope made by the hold-down rollers 122 arranged in contact with the hold-down rollers 122. In this arrangement, when the driving roller 130 rotates, the hold-down rollers 122 can be rotated.

In the foregoing description, an alternative structure of the plate heater 120 may comprise a plate member made of a heat conductor and a heat source arranged on the side of the plate member opposite the heated surface of the photothermographic material.

The present invention will be further described in the following examples, but the present invention should not be construed as being limited thereto.

EXAMPLE 1

<<Preparation of PET support>>

Terephthalic acid and ethylene glycol were subjected to ordinary processing to obtain PET having an intrinsic viscosity IV of 0.66 (measured in a 6/4 mixture (by weight) of phenol and tetrachloroethane at 25° C.). PET thus pelletized was dried at a temperature of 130° C. for 4 hours, melted at a temperature of 300° C., extruded through a T-die, and then rapidly cooled to prepare an unoriented film having a thickness such that it reaches 175 $\mu$m after thermally fixed.

The unoriented film was longitudinally oriented at a draw ratio of 3.3 and a temperature of 110° C. by means of rolls having different peripheral speeds, and then crosswise oriented at a draw ratio of 4.5 and a temperature of 130° C. by means of a tenter. Thereafter, the film thus oriented was thermally fixed at a temperature of 240° C. for 20 seconds, and then crosswise relaxed by 4% at the same temperature. Thereafter, the tenter was provided with a slit at the chuck portion thereof and then knurled at both ends thereof. The film thus oriented was then wound on the tenter at a tension of 4 kg/cm$^2$ to obtain a roll of a film having a thickness of 175 $\mu$m.

<<Surface corona treatment>>

Using a Type 6KVA solid state corona treatment apparatus produced by Pillar Inc., the support thus prepared was treated at room temperature on the both sides thereof at a rate of 20 m/min. The measurements of current and voltage showed that the support was treated at an intensity of 0.375 kV·A·min/m$^2$. The treatment frequency was 9.6 KHz, and the clearance between the electrode and the dielectric roll was 1.6 mm.

<<Preparation of Undercoated Support>>

(Preparation of undercoating solution A)

To 200 ml of an aqueous dispersion of polyester copolymer (Pesresin A-515GB; 30 wt-%, produced by Takamatsu Oil & Fat Co., Ltd.) were then added 1 g of a particulate polystyrene (average particle diameter: 0.2 $\mu$m), 20 ml of the following surface active agent (A) (1 wt-%) and a 20wt-% dispersion of the following pigment C. I. Pigment Blue 60 in an amount required for optical density set forth in Table 1. To the mixture was then added distilled water to make 1,000 ml. Thus, an undercoating solution A was obtained.

Surface active agent (A)

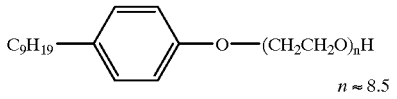

(Preparation of undercoating solution B)

To 680 ml of distilled water were then added 200 ml of an aqueous dispersion of styrene-butadiene copolymer (47/50/3 (by weight) mixture of styrene, butadiene and itaconic acid; concentration: 30 wt-%) and 0.1 g of a particulate polystyrene (average particle diameter: 2.5 $\mu$m). To the mixture was then added distilled water to make 1,000 ml. Thus, an undercoating solution B was obtained.

(Preparation of undercoating solution C)

10 g of inert gelatin was dissolved in 500 ml of distilled water. To the solution was then added 40 g of a 40 wt-% aqueous dispersion of a particulate tin oxide-antimony oxide composite described in JP-A-61-20033. To the mixture was then added distilled water to make 1,000 ml. Thus, an undercoating solution C was obtained.

(Preparation of undercoated support)

To the support which had been subjected to corona discharge treatment was applied the undercoating solution A by means of a bar coater in an amount such that the wet coated amount reached 5 ml/m$^2$. The coated material was then dried at a temperature of 180° C. for 5 minutes. The dry thickness was about 0.3 $\mu$m. The support was then subjected to corona discharge treatment on the other side thereof (back surface). The undercoating solution B was applied to the back surface of the support by means of a bar coater in an amount such that the wet coated amount reached 5 ml/m$^2$ and the dry thickness reached about 0.3 $\mu$m, and then dried at a temperature of 180° C. for 5 minutes. The undercoating solution C was applied to the undercoated surface of the support by means of a bar coater in an amount such that the wet coated amount reached 3 ml/m$^2$ and the dry thickness reached about 0.03 $\mu$m, and then dried at a temperature of 180° C. for 5 minutes to prepare an undercoated support.

(Preparation of emulsion dispersion of dye)

8 g of the following dye compound (a) and 16 g of a polymethyl methacrylate were dissolved in 250 ml of methyl acetate to prepare a mother liquor of dispersion. To the mother liquor was then added 1 g of the following surface active agent (B). The mixture was then added to 400 ml of a 2 wt-% gelatin solution which had been kept at a temperature of 40° C. The mixture was then stirred at a rotary speed of 12,000 rpm by means of a homogenizer (Type HF93, produced by SMT Corp.) in accordance with ordinary process for 5 minutes to prepare an emulsion dispersion.

The emulsion dispersion thus prepared was then subjected to treatment by an evaporator at a temperature of 65° C. so that ethyl acetate was gradually evaporated in 2 hours. After the removal of ethyl acetate, the emulsion dispersion was then replenished with distilled water to make 400 g. Thus, a 2 wt-% emulsion dispersion (a) of dye compound was prepared.

Dye compound (a)

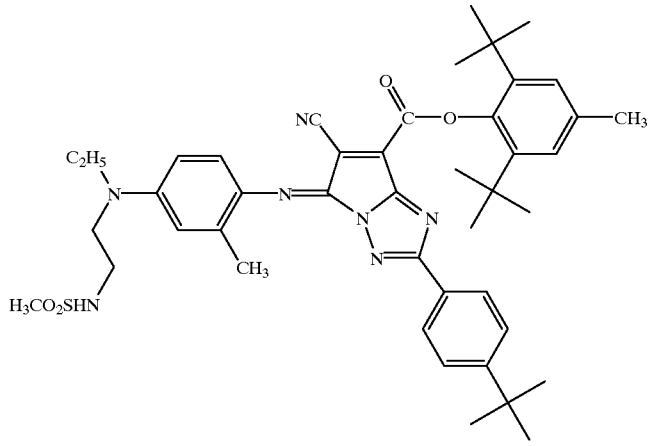

Surface active agent (B)

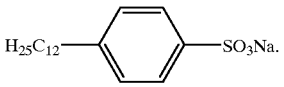

Similarly, the following dye compounds (b), (c) and (d) were used to prepare 2 wt-% emulsion dispersion of dyes (b), (c) and (d), respectively.

Dye compound (b)

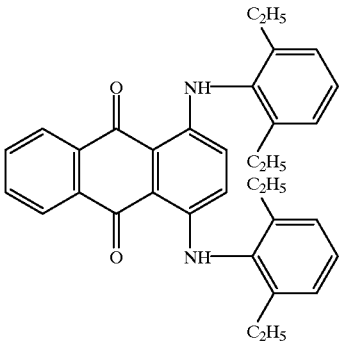

Dye compound (c)

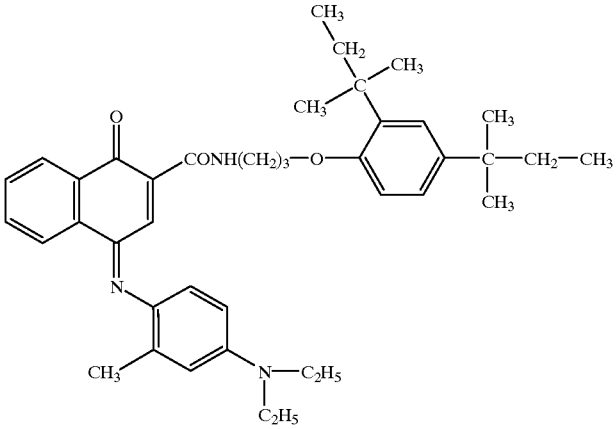

Dye compound (d)

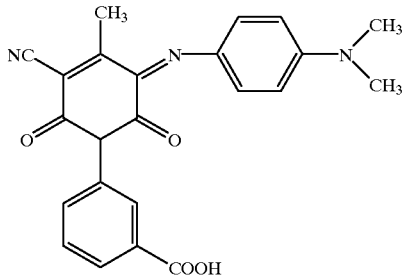

<<Preparation of 20 wt-% Dispersion of Pigment>>

To a mixture of 64 g of C. I. Pigment Blue 60 and 6.4 g of Demol N produced by Kao Corp. was added 250 g of water. The mixture was thoroughly mixed to make a slurry. 800 g of zirconia beads having an average diameter of 0.5 mm were then prepared. The zirconia beads were then put into a vessel with the foregoing slurry. The mixture was then subjected to dispersion by means of a dispersing apparatus (¼G sand grinder mill produced by Aimex Co., Ltd.) for 25 hours to obtain a pigment dispersion. The pigment particles contained in the pigment dispersion thus obtained had an average particle diameter of 0.21 μm.

<<Preparation of organic acid silver dispersion>>

To a mixture of 43.8 g of behenic acid (trade name: Edenor C22-85R) produced by Henkel Japan Ltd., 730 ml of distilled water and 60 ml of tert-butanol was added 117 ml of a 1 N aqueous solution of NaOH with stirring at a temperature of 79° C. in 55 minutes. The reaction mixture was allowed to undergo reaction for 240 minutes. Subsequently, to the reaction solution was then added 112.5 ml of an aqueous solution containing 19.2 g of silver nitrate in 45 seconds. The reaction mixture was then allowed to stand for 20 seconds. The temperature of the reaction mixture was then lowered to 30° C. Thereafter, the resulting solid content was withdrawn by suction filtration, and then washed with water until the conductivity of the filtrate reached 30 μS/cm. The solid content thus obtained was then handled undried as a wet cake. To the wet cake in a dried amount of 100 g were then added 7.4 g of a polyvinyl alcohol (trade name: PVA-205) and water to make 385 g. The mixture was then subjected to predispersion by means of a homomixer.

Subsequently, the stock solution thus predispersed was subjected to dispersion three times by means of a dispersing apparatus (trade name: Microfluidizer M-110S-EH, produced by Microfuidex International Corporation, using G10Z interaction chamber) at a pressure of 1,750 kg/cm$^2$ to obtain a silver behenate dispersion B. The silver behenate particles contained in the silver behenate dispersion B were acicular particles having an average short diameter of 0.04 μm, an average long diameter of 0.8 μm and a variation coefficient of 30%. For the measurement of the particle size, Master Sizer X produced by Malvern Instruments Ltd. was used. Referring to cooling operation, the interaction chamber was provided with a coil heat exchanger at the inlet and outlet thereof. In this arrangement, the temperature of the coolant was controlled such that the desired dispersion temperature was reached.

<<Preparation of 25 wt-% Dispersion of Reducing Agent>>

To a mixture of 80 g of 1, 1-bis(2-hydroxy-3,5-dimethylphenyl)-3,5,5-trimethylhexane and 70 g of a 20 wt-% aqueous solution of Poval MP203 (modified polyvinyl alcohol produced by KURARAY CO., LTD.) were added 176 g of water. The mixture was then thoroughly stirred to make a slurry. 700 g of zirconia beads having an average particle diameter of 0.5 mm were then prepared. The zirconia beads were then put into a vessel with the foregoing slurry. The mixture was then subjected to dispersion by means of a dispersing apparatus (¼G sand grinder mill produced by Aimex Co., Ltd.) for 5 hours to obtain a dispersion of reducing agent. The reducing agent particles contained in the dispersion of reducing agent thus obtained had an average particle diameter of 0.8 μm.

<<Preparation of 20 wt-% Dispersion of Mercapto Compound>>

To a mixture of 64 g of 3-mercapto-4-phenyl-5-heptyl-1,2,4-triazole and 32 g of a 20 wt-% aqueous solution of Poval MP203 (modified polyvinyl alcohol produced by KURARAY CO., LTD.) were added 224 g of water. The mixture was then thoroughly stirred to make a slurry. 800 g of zirconia beads having an average particle diameter of 0.5 mm were then prepared. The zirconia beads were then put into a vessel with the foregoing slurry. The mixture was then subjected to dispersion by means of a dispersing apparatus (¼G sand grinder mill produced by Aimex Co., Ltd.) for 10 hours to obtain a mercapto dispersion. The mercapto compound particles contained in the dispersion of mercapto compound thus obtained had an average particle diameter of 0.67 μm.

<<Preparation of 30 wt-% Dispersion of Organic Polyhalogen Compound>>

To a mixture of 48 g of tribromomethylphenylsulfone, 48 g of 3-tribromomethylsulfonyl-4-phenyl-5-tridecyl-1,2,4-triazole and 48 g of a 20 wt-% aqueous solution of Poval MP203 (modified polyvinyl alcohol produced by KURARAY CO., LTD.) were added 224 g of water. The mixture was then thoroughly stirred to make a slurry. 800 g of zirconia beads having an average particle diameter of 0.5 mm were then prepared. The zirconia beads were then put into a vessel with the foregoing slurry. The mixture was then subjected to dispersion by means of a dispersing apparatus (¼G sand grinder mill produced by Aimex Co., Ltd.) for 5 hours to obtain a dispersion of organic polyhalogen compound. The polyhalogen compound particles contained in the dispersion of polyhalogen compound thus obtained had an average particle diameter of 0.74 μm.

<<Preparation of Methanol Solution of Phthalazine Compound>>

26 g of 6-isopropyl phthalazine was dissolved in 100 ml of methanol to obtain the desired methanol solution.

<<Preparation of Particulate Silver Halide 1>>

To 1,421 cc of distilled water was added 6.7 cc of a 1 wt-% solution of potassium bromide. To the solution were then added 8.2 cc of 1 N nitric acid and 21.8 g of phthalated gelatin. To the solution thus obtained were then added a solution a1 obtained by diluting 37.04 g of silver nitrate with distilled water to make 159 cc and a solution b1 obtained by diluting 32.6 g of potassium bromide with distilled water to make 200 cc with stirring in a titanium-coated stainless steel reaction vessel by a controlled double jet process while the liquid temperature was being kept at 35° C. and the pAg value of the solution was being kept at 8.1. Thus, the total amount of the solution a1 was added at a constant flow rate in 1 minute. (The solution b1 was added by a controlled double jet process) Thereafter, to the reaction solution was added 30 cc of a 3.5 wt-% aqueous solution of hydrogen peroxide. To the reaction solution was then added 33.6 cc of a 3 wt-% aqueous solution of benzoimidazole. Thereafter, to the reaction solution were added a solution a2 obtained by diluting the solution al with distilled water to make 317.5 cc and a solution b2 obtained by dissolving hexachlorinated dipotassium iridiumate in the solution b1 in a final concentration of $1\times10^{-4}$ mols per mol of silver, and then diluting the solution with distilled water to make 400 cc, which is double the volume of the solution b1, by a controlled double jet process while the pAg value of the solution was being kept at 8.1. Thus, the total amount of the solution a2 was added at a constant flow rate in 10 minutes. (The solution b2 was added by a controlled double jet process) Thereafter, to the reaction solution was added 50 cc of a 0.5 wt-% methanol solution of 2-mercapto-5-methylbenzoimidazole. The reaction solution was then adjusted with silver nitrate to pAg 7.5. The reaction solution was then adjusted with 1 N sulfuric acid to pH 3.8. The stirring was then terminated. The reaction solution was then subjected to sedimentation, desalting and rinsing. To the reaction solution were then added 3.5 g of deionized gelatin and 1 N sodium hydroxide to adjust the pH value and pAg thereof to 6.0 and 8.2, respectively. Thus, a silver halide dispersion was prepared.

The particles in the silver halide emulsion thus obtained were pure silver bromide particles having an average sphere diameter of 0.031 μm and a sphere diameter variation coefficient of 11%. For the measurement of particle size, etc., an electron microscope was used. The measurements of 1,000 particles were averaged to determine particle size. The proportion of {100} plane in the particle was 85% as determined by Kvelkamunk (??) method.

The foregoing emulsion was heated with stirring to a temperature of 50° C. where 5 cc of a 0.5 wt-% methanol solution of N,N'-dihydroxy-N", N"-diethylmelamine and 5 cc of a 3.5 wt-% methanol solution of phenoxyethanol were then added thereto. After 1 minute, to the emulsion was then added sodium benzenethiosulfonate in an amount of $3\times10^{-5}$ mols per mol of silver. After 2 minutes, to the emulsion was then added a solid dispersion (aqueous solution of gelatin) of the following spectrally sensitized dye (1) in an amount of $5\times10^{-3}$ mols per mol of silver. After 2 minutes, to the emulsion was then added the following tellurium sensitizer (2) in an amount of $5\times10^{-5}$ mols per mol of silver. The emulsion was then ripened for 50 minutes. When ripening was about to end, 2-mercapto-5-methylbenzoimidazole was then added to the emulsion in an amount of $1\times10^{-3}$ mols per mol of silver. The temperature of the emulsion was then lowered to terminate chemical sensitization. Thus, a particulate silver halide 1 was prepared.

<<Preparation of Particulate Silver Halide 2>>

22 g of phthalated gelatin and 30 mg of potassium bromide were dissolved in 700 ml of water. The solution was adjusted to pH 5.0 at a temperature of 35° C. To the solution were then added 159 ml of an aqueous solution containing 18.6 g of silver nitrate and 0.9 g of ammonium nitrate and an aqueous solution containing potassium bromide and potassium iodide at a molar ratio of 92:8 by a controlled double jet process while the pAg value thereof was being kept at 7.7 in 10 minutes. Subsequently, to the emulsion were added 476 ml of an aqueous solution containing 55.4 g of silver nitrate and 2 g of ammonium nitrate and an aqueous solution containing hexachlorinated dipotassium iridiumate and potassium bromide in an amount of $1\times10^{-5}$ mols and 1 mol per 1, respectively, by a controlled double jet process while the pAg value thereof was being kept at 7.7 in 30 minutes. To the emulsion was then added 1 g of 4-hydroxy-6-methyl-1,3,3a, 7-tetrazaindene. The pH value of the emulsion was then lowered to cause agglomeration and sedimentation so that the emulsion was desalted.

Thereafter, 0.1 g of phenoxyethanol was added to the emulsion to adjust the pH value and pAg value thereof to 5.9 and 8.2, respectively. Thus, the preparation of a particulate silver bromoiodide (cubic particle having a iodine-containing core content of 8 mol-%, an average iodine content of 2 mol-%, an average size of 0.05 μm, a projected area variation coefficient of 8% and a {100} plane proportion of 88%) was terminated.

The particulate silver halide thus obtained was heated to a temperature of 60° C. where sodium thiosulfate, 2,3,4,5,6-pentafluorophenyldiphenylphosphine selenide, tellurium sensitizer (2), chloroauric acid and thiocyanic acid were then added thereto in an amount of $8.5\times10^{-5}$ mols, $1.1\times10^{-5}$ mols, $1.5\times10^{-5}$mols, $3.5\times10^{-8}$ mols and $2.7\times10^{-4}$ mols per mol of silver, respectively. The emulsion was ripened for 120 minutes, and then rapidly cooled to a temperature of 40° C. To the emulsion were then added the spectrally-sensitized dye (1) in an amount of $1\times10^{-4}$ mols and 2-mercapto-5-methylbenzoimidazole in an amount of $5\times10^{-4}$ mols. The emulsion was then rapidly cooled to a temperature of 30° C. to obtain a silver halide emulsion 2.

<<Preparation of Emulsion Layer Coating Solution>>

(Emulsion layer coating solution)

103 g of the foregoing organic acid silver dispersion and 5 g of a 20 wt-% aqueous solution of a polyvinyl alcohol PVA-205 (produced by KURARAY CO., LTD.) were mixed. To the mixture which had been kept at a temperature of 40° C. were then added 23.2 g of the foregoing 25 wt-% dispersion of reducing agent, a 20 wt-% aqueous dispersion of the foregoing C. I. Pigment Blue 60 in an amount required to obtain the optical density set forth in Table 1 (no addition in Sample No. 2), 15 g of a 30 wt-% dispersion of an organic polyhalogen compound, and 4 g of a 20 wt-% dispersion of a mercapto compound. Thereafter, to the emulsion was added 106 g of a 40 wt-% SBR latex which had been ultrafiltrated/purified and kept at a temperature of 40° C. The mixture was then thoroughly stirred. To the mixture was then added 6 ml of a methanol solution of a phthalazine compound to obtain a solution of organic acid silver. The organic acid silver solution thus obtained was mixed with an emulsion previously prepared by thoroughly mixing 4 g of the particulate silver halide 1 and 5 g of the particulate silver halide 2 by a static mixer shortly before coating to prepare an emulsion layer coating solution which was then directly fed into a coating die at a flow rate such that the coated amount of silver reached 1.4 g/m$^2$.

The viscosity of the emulsion layer coating solution thus obtained was 85 [mpa·s] at 40° C. (No. 1 rotor) as determined by means of a Type B viscometer produced by Tokyo Keiki Kogyo K.K. The emulsion layer coating solution also exhibited a 25° C. viscosity of 1,500, 220, 70, 40 and 20 [mPa·s] at a shearing rate of 0.1, 1, 10, 100 and 1,000 [1/sec], respectively, as determined by means of an RFS fluid spectrometer produced by Rheometrix Far East Co., Ltd.

The SBR latex which had been ultrafiltrated and purified was obtained as follows.

The following SBR latex was diluted with distilled water 10 times, and then diluted and purified using a Type FS03-FC-FUYO3A1 module for ultrafiltration/purification (Daicene Membrane System Co., Ltd.) until the ionic conductivity reached 1.5 mS/cm. The latex concentration was 40 wt-%. (SBR latex: latex of -St(68)-Bu(29)-AA(3)-)

Average particle diameter: 0.1 μm; equilibrium moisture content at 25° C. and 60%RH: 0.6 wt-%; concentration: 45wt-%; ionic conductivity: 4.2 mS/cm (40% mother liquor of latex was measured by a Type CM-30S conductivity meter produced by TOA Electronics Limited at a temperature of 25° C.); pH 8.2

<<Preparation of Coating Solution of Interlayer on the Surface of Emulsion Layer>>

To a mixture of 772 g of a 10 wt-% aqueous solution of a polyvinyl alcohol PVA-205 (produced by KURARAY CO., LTD.) and 226 g of a 27.5 wt-% solution of a methyl methacrylate/styrene/2-ethylhexyl acrylate/hydroxyethyl methacrylate/acrylic acid copolymer (copolymerization ratio by weight: 59/9/26/5/1) latex were added 2 ml of a 5 wt-% aqueous solution of Aerosol OT (produced by American Cyanamide Inc.), 4 g of benzyl alcohol, 1 g of 2,2,4-trimethyl-1,3-pentanediol monoisobutyrate, 10 mg of benzoisothiazoline, and a 20 wt-% aqueous dispersion of the foregoing C. I. Pigment Blue 60 in an amount required to obtain the optical density set forth in Table 1 to obtain an interlayer coating solution which was then fed into the coating die at a rate such that the coated amount thereof reached 5 ml/m$^2$.

The viscosity of the coating solution was 21 [mPa·s] as determined by a Type B viscometer (No. 1 rotor, 60 rpm) at a temperature of 40° C.

<<Preparation of Coating Solution of 1st Protective Layer on the Surface of Emulsion Layer>>

(1st Protective layer coating solution)

80 g of inert gelatin was dissolved in water. To the aqueous solution of inert gelatin were then added 138 ml of a 10 wt-% methanol solution of phthalic acid, 28 ml of 1 N sulfuric acid, 5 ml of a 5 wt-% aqueous solution of Aerosol OT (produced by American Cyanamide Co., Ltd.), 1 g of phenoxyethanol, a 20 wt-% aqueous dispersion of the foregoing C. I. Pigment Blue 60 in an amount required to obtain the optical density set forth in Table 1 and water to make 1,000 g. Thus, a 1st protective layer coating solution was prepared. The coating solution was then fed into the coating die at a flow rate such that the coated amount thereof reached 10 ml/m$^2$.

The viscosity of the coating solution was 17 [mPa·s] as determined by a Type B viscometer at a temperature of 40° C.

<<Preparation of Coating Solution of 2nd Protective Layer on the Surface of Emulsion Layer>>

(Coating solution of 2nd protective layer)

100 g of inert gelatin was dissolved in water. To the solution were then added 20 ml of potassium salt of N-perfluorooctylsulfonyl-N-propyl alanine, 16 ml of a 5 wt-% solution of Aerosol 0T (American Cyanamide Inc.), 25 g of a particulate polymethyl methacrylate (average particle diameter: 4.0 μm), 44 ml of 1 N sulfuric acid, 10mg of benzoisothiazolinone, and water to make 1,555 g. The emulsion thus obtained was mixed with 445 ml of an aqueous solution containing 4 wt-% of chrome alum and 0.67wt-% of phthalic acid shortly before coating by means of a static mixer to obtain a coating solution of 2nd protective layer which was then fed into the coating die at a flow rate such that the coated amount thereof reached 10 ml/m$^2$.

The viscosity of the coating solution was 9 [mpa·s] as determined by a Type B viscometer (No. 1 rotor, 60 rpm) at a temperature of 40° C.

<<Preparation of Coating Solution on the Back Surface>>

(Preparation of solid particle dispersion of basic precursor)

64 g of a basic precursor compound (3), 14 g of a diphenylsulfone compound (4) and 10 g of a surface active agent Demor N produced by Kao Corp. were mixed with 224 ml of distilled water. The mixture was then subjected to bead dispersion by means of a sand mill (¼G sand grinder mill produced by Aimex Co., Ltd.) to obtain a solid particulate dispersion of basic precursor having an average particle diameter of 0.2 μm.

(Preparation of solid particulate dispersion of dye)

9.6 g of the following cyanine dye compound and 5.8 g of sodium p-alkylbenzenesulfonate were mixed with 305 ml of distilled water. The mixture was then subjected to bead dispersion by means of a sand mill (¼G sand grinder mill produced by Aimex Co., Ltd.) to obtain a solid particulate dispersion of dye having an average particle diameter of 0.2 μm.

(Preparation of anti-halation layer coating solution)

17 g of gelatin, 9.6 g of a polyacrylamide, 70 g of the foregoing solid particulate dispersion of basic precursor, 56 g of the foregoing solid particulate dispersion of dye, 1.5 g of a particulate polymethyl methacrylate (average particle size: 6.5 μm), 2.2 g of sodium polyethylenesulfonate, 0.2 g of the following colored dye compound (6) and 844 ml of $H_2O$ were mixed to prepare an anti-halation layer coating solution.

(Preparation of coating solution of protective layer on the back surface) 50 g of gelatin, 0.2 g of sodium polystyrene sulfonate, 2.4 g of N,N'-ethylenebis(vinylsulfonacetamide), 1 g of sodium t-octylpheoxyethoxyethanesulfonate, 30 mg of benzoisothiazolinone, 32 mg of $C_8F_{17}SO_3K$, 64 mg of $C_8F_{17}SO_2N(C_3H_7)(CH_2CH_2O)_4(CH_2)_4—SO_3Na$ and 950 ml of $H_2O$ were mixed in a vessel which had been kept at a temperature of 40° C. to prepare a protective layer coating solution.

Spectrally-sensitized dye (1)

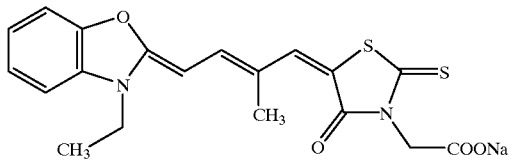

Tellurium sensitizer (2)

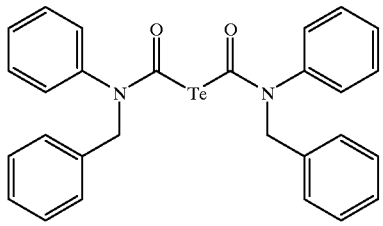

Basic precursor compound (3)

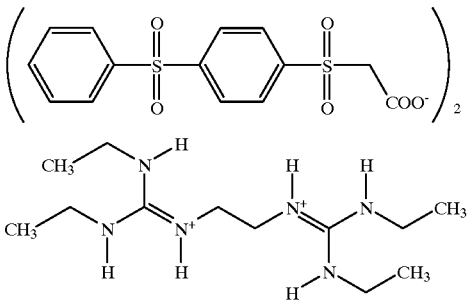

Diphenylsulfone compound (4)

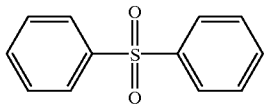

Cyanine dye compound (5)

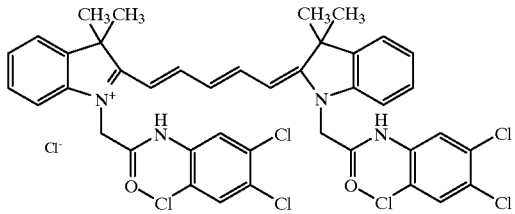

Colored dye compound (6)

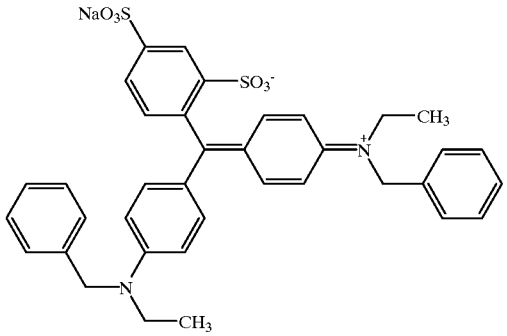

<<Preparation of Photothermographic Material>>

To the foregoing undercoated support were then simultaneously applied the anti-halation layer coating solution and the protective layer coating solution in an amount such that the coated amount of solid content of solid particulate dye and the coated amount of gelatin reached 0.04 g/m$^2$ and 1 g/m$^2$, respectively. The coated material was then dried to prepare an anti-halation back layer. Thereafter, to the other side of the support were simultaneously applied the coating solutions of interlayer, 1st protective layer and 2nd protective layer in this order from the undercoated surface thereof by a slide bead coating method to prepare Sample Nos. 2 and 3 of photothermographic material. The application of the emulsion layer coating solution was effected with the support left unwound after being coated with the back layer coating solution.

The coating was effected at a rate of 160 mm/min. During coating, the gap between the tip of the coating die and the support was kept at 0.18 mm. The pressure in the vacuum chamber was kept 392 Pa lower than the atmospheric pressure. In the subsequent chilling zone, air having a dry-bulb temperature of 18° C. and a wet-bulb temperature of 12° C. was blown against the coated material at an average velocity of 7 m/sec for 30 seconds so that the coating solutions thus applied were cooled. In the subsequent helical suspended drying zone, drying air having a dry-bulb temperature of 30° C. and a wet-bulb temperature of 18° C. was blown against the coated material at a velocity of 20 m/sec from nozzle for 200 seconds so that the solvent was evaporated from the coating solutions.

Sample No. 1 was prepared in the same manner as Sample No. 3 except that the undercoating solution (A) and the coating solutions of interlayer and 1st protective layer were free of dispersion of C. I. Pigment Blue 60 (the amount of C.I. Pigment Blue 60 in the photosensitive layer was controlled). Further, Sample Nos. 4 to 11 were prepared in the same manner as Sample No. 3 except that the undercoating solution (A) and the coating solutions of interlayer and 1st protective layer comprised the foregoing dye emulsions (a), (b), (c) and (d) incorporated therein instead of dispersion of C. I. Pigment Blue 60.

The optical density in Table 1 is represented by the increase of optical density of film sample comprising a color dye or pigment incorporated in the layer in question from film sample free of color dye or pigment at 660 nm as calculated in terms of absorbance. For the measurement of absorbance, a Type U-3500 spectrophotometer produced by Hitachi, Ltd. was used. During measurement, the sample was disposed at the inlet of an integrating sphere having an inner diameter of 200 mm.

(Increase of development fog)

Sample Nos. 1 to 11 of photothermographic material thus prepared were subjected to heat development at a temperature of 123° C. for 20 seconds by a heat developing machine equipped with a plate heater type heat development zone as shown in FIG. 1 of Japanese Patent Application No. 9-229684 in dark room. The samples thus developed were then measured for fog increase from the undeveloped samples.

Measurement of Sharpness (MTF)

The sample was exposed to light beam emitted by a 660 nm semi-conductor laser, subjected to heat development by the foregoing heat developing machine at a temperature of 123° C. for 20 seconds, and then measured for MTF. For the measurement of MTF, an aperture having a size of 30 μm×500 μm was used. MTF value at a space frequency of 2.5 cycles/mm was evaluated at the area having an optical density of 1.0.

Measurement of Dmin (minimum density)

The sample thus prepared was freed of back layer, and then measured for density by means of a Type TD-904Macbeth densitometer in a visual mode. The value obtained with the base alone was then subtracted from the measurements to determine Dmin.

The results are set forth in Table 1.

As can be seen in Table 1, the samples of the present invention exhibit a small Dmin, little development fog and an excellent sharpness. In other words, the samples of the present invention can provide an excellent sharpness with less Dmin and development fog as compared with the comparative samples. Further, the incorporation of a pigment in the photosensitive layer makes it possible to inhibit discoloration during storage.

EXAMPLE 2

(Preparation of organic silver salt dispersion A)

To a mixture of 43.8 g of behenic acid (trade name: Edenor C22-85R) produced by Henkel Japan Ltd., 730 ml of distilled water and 60 ml of tert-butanol was added 117 ml of a 1 N aqueous solution of NaOH with stirring at a temperature of 79° C. in 55 minutes. The reaction mixture was allowed to undergo reaction for 240 minutes. Subsequently, to the reaction solution was then added 112.5 ml of an aqueous solution containing 19.2 g of silver nitrate in 45 seconds. The reaction mixture was then allowed to stand for 20 seconds. The temperature of the reaction mixture was then lowered to 30° C. Thereafter, the resulting solid content was withdrawn by suction filtration, and then washed with water until the conductivity of the filtrate reached 30 μS/cm. The solid content thus obtained was then handled undried as a wet cake. To the wet cake in a dried amount of 100 g were then added 4 g of a polyvinyl alcohol (trade name: PVA-205) and water tomake 385 g. The mixture was then subjected to predispersion by means of a homomixer.

Subsequently, the stock solution thus predispersed was subjected to dispersion three times by means of a dispersing apparatus (trade name: Microfluidizer M-110S-EH, produced by Microfuidex International Corporation, using G10Z interaction chamber) at a pressure of 1,750 kg/cm$^2$ to obtain a silver behenate dispersion B. The silver behenate particles contained in the silver behenate dispersion B were acicular particles having an average short diameter of 0.04 μm, an average long diameter of 0.8 μm and a variation coefficient of 30%. For the measurement of the particle size, Master Sizer X produced by Malvern Instruments Ltd. was used. Referring to cooling operation, the interaction cham-

TABLE 1

| | | Anti-irradiation optical density | | | | | |
|---|---|---|---|---|---|---|---|
| Sample No. | Bluish dye in light insensitive layer | Under coating layer | Photo-Sensitive layer | Photo-Sensitive layer + protective layer | Dmin Macbeth (V) | Development fog increase | Sharpness |
| 1 (Comparative) | — | — | 0.33 | — | 0.25 | 0.07 | 99 |
| 2 (Comparative) | Pigment (C.I. Pigment Blue 60) | 0.11 | — | 0.22 | 0.25 | 0.01 | 90 |
| 3 (Present Invention) | Pigment (C.I. Pigment Blue 60) | 0.05 | 0.05 | 0.05 | 0.12 | 0.01 | 94 |
| 4 (Present Invention) | Dye (a) | 0.11 | 0.11 | 0.11 | 0.12 | 0.04 | 99 |
| 5 (Present Invention) | Dye (a) | 0.05 | 0.05 | 0.05 | 0.06 | 0.01 | 94 |
| 6 (Present Invention) | Dye (b) | 0.11 | 0.11 | 0.11 | 0.12 | 0.04 | 100 |
| 7 (Present Invention) | Dye (b) | 0.05 | 0.05 | 0.05 | 0.06 | 0.01 | 95 |
| 8 (Present Invention) | Dye (c) | 0.11 | 0.11 | 0.11 | 0.12 | 0.04 | 99 |
| 9 (Present Invention) | Dye (c) | 0.05 | 0.05 | 0.05 | 0.06 | 0.01 | 95 |
| 10 (Present Invention) | Dye (d) | 0.11 | 0.11 | 0.11 | 0.12 | 0.04 | 97 |
| 11 (Present Invention) | Dye (d) | 0.05 | 0.05 | 0.05 | 0.06 | 0.01 | 93 |

ber was provided with a coil heat exchanger at the inlet and outlet thereof. In this arrangement, the temperature of the coolant was controlled such that the desired dispersion temperature was reached.

(Preparation of 25 wt-% dispersion A of reducing agent)

To a mixture of 80 g of 1,1-bis(2-hydroxy-3,5-dimethylphenyl)-3,5,5-trimethylhexane and 64 g of a 20 wt-% aqueous solution of Poval MP203 (modified polyvinyl alcohol produced by KURARAY CO., LTD.) were added 176 g of water. The mixture was then thoroughly stirred to make a slurry. 800 g of zirconia beads having an average particle diameter of 0.5 mm were then prepared. The zirconia beads were then put into a vessel with the foregoing slurry. The mixture was then subjected to dispersion by means of a dispersing apparatus (¼G sand grinder mill produced by Aimex Co., Ltd.) for 5 hours to obtain a dispersion of reducing agent. The reducing agent particles contained in the dispersion of reducing agent thus obtained had an average particle diameter of 0.72 μm.

<<Preparation of Emulsion Layer Coating Solution>>

(Emulsion layer coating solution)

An emulsion layer coating solution was prepared in the same manner as in the preparation of photothermographic material of Example 1 with the following exception. In some detail, 98 g of the foregoing organic silver salt dispersion A as an organic acid silver dispersion was mixed with 5 g of a 20 wt-% aqueous solution of a polyvinyl alcohol PVA-205 (produced by KURARAY CO., LTD.). To the mixture which had been kept at a temperature of 40° C. were then added 23.2 g of the foregoing 25 wt-% reducing agent dispersion A as a reducing agent dispersion, a 20 wt-%, aqueous dispersion of C. I. Pigment Blue 60 in an amount required to obtain the optical density set forth in Table 2, 15 g of a 30 wt-% dispersion of organic polyhalogen compound and 4 g of a 20% dispersion of mercapto compound. Thereafter, to the emulsion was added 106 g of a 40 wt-% SBR latex which had been ultrafiltrated/purified and kept at a temperature of 40° C. The mixture was then thoroughly stirred. To the mixture was then added 7 ml of a 10 wt-% methanol solution of 6-isopropyl phthalazine to obtain a solution of organic acid silver. The organic acid silver solution thus obtained was mixed with an emulsion previously prepared by thoroughly mixing 4 g of the particulate silver halide 1 and 2 g of the particulate silver halide 2 by a static mixer shortly before coating to prepare an emulsion layer coating solution which was then directly fed into a coating die at a flow rate such that the coated amount of silver reached 1.4 g/m$^2$.

<<Preparation of Coating Solution of Interlayer on the Surface of Emulsion Layer>>

(Interlayer coating solution)

To a mixture of 772 g of a 10 wt-% aqueous solution of a polyvinyl alcohol PVA-205 (produced by KURARAY CO., LTD.) and 226 g of a 27.5 wt-% solution of a methyl methacrylate/styrene/2-ethylhexyl acrylate/hydroxyethyl methacrylate/acrylic acid copolymer (copolymerization ratio by weight: 59/9/26/5/1) latex were added 2 ml of a 5 wt-% aqueous solution of Aerosol 0T (produced by American Cyanamide Inc.), 4 g of benzyl alcohol, 1 g of 2,2,4-trimethyl-1,3-pentanediol monoisobutyrate, 10 mg of benzoisothiazoline, and a 20 wt-% aqueous dispersion of the foregoing C. I. Pigment Blue 60 in an amount required to obtain the optical density (including that of the following 1st protective layer) set forth in Table 2 with 30 g as a standard to obtain an interlayer coating solution which was then fed into the coating die at a rate such that the coated amount thereof reached 5 ml/m$^2$.

The viscosity of the coating solution was 21 [mPa·s] as determined by a Type B viscometer (No. 1 rotor, 60 rpm) at a temperature of 40° C.

<<Preparation of Coating Solution of 1st Protective Layer on the Surface of Emulsion Layer>>

(1st Protective layer coating solution)

80 g of inert gelatin was dissolved in water. To the aqueous solution of inert gelatin were then added 138 ml of a 10 wt-% methanol solution of phthalic acid, 28 ml of 1 N sulfuric acid, 5 ml of a 5 wt-% aqueous solution of Aerosol 0T (produced by American Cyanamide Co., Ltd.) 1 g of phenoxyethanol, a 20 at-% aqueous dispersion of the foregoing C. I. Pigment Blue 60 in an amount required to obtain the optical density (including that of the foregoing interlayer) set forth in Table 1 with 30 g as a standard and water to make 1,000 g. Thus, a 1st protective layer coating solution was prepared. The coating solution was then fed into the coating die at a flow rate such that the coated amount thereof reached 10 ml/m$^2$.

The viscosity of the coating solution was 17 [mPa·s] as determined by a Type B viscometer at a temperature of 40° C.

<<Preparation of Photothermographic Material>>

To the foregoing undercoated support were then simultaneously applied the anti-halation layer coating solution and the protective layer coating solution in an amount such that the coated amount of solid content of solid particulate dye and the coated amount of gelatin reached 0.04 g/m$^2$ and 1 g/m$^2$, respectively, in the same manner as in Example 1. The coated material was then dried to prepare an anti-halation back layer. Thereafter, to the other side of the support were simultaneously applied the coating solutions of emulsion layer, interlayer, 1st protective layer and 2nd protective layer in this order from the undercoated surface thereof by a slide bead coating method to prepare Samples of photothermographic material.

TABLE 2

| | Anti-irradiation optical density | | | | | |
|---|---|---|---|---|---|---|
| Sample No. | under-coating layer | Photo-sensitive layer | Interlayer + protective layer | Light-insensitive layer/(photo-sensitive layer + light-insensitive layer) ratio | Sharpness | Develop-ment fog increase |
| 1 (Comparative) | — | 0.3 | — | 0/0.3 [0%] | 98 | 0.06 |
| 2 (Invention) | 0.05 | 0.2 | 0.05 | 0.1/0.3 [33%] | 99 | 0.03 |
| 3 (Invention) | — | 0.2 | 0.1 | 0.1/0.3 [33%] | 98 | 0.03 |
| 4 (Invention) | 0.1 | 0.2 | — | 0.1/0.3 [33%] | 98 | 0.03 |
| 5 (Invention) | 0.1 | 0.1 | 0.1 | 0.2/0.3 [66%] | 99 | 0.01 |

TABLE 2-continued

| Sample No. | Anti-irradiation optical density: under-coating layer | Photo-sensitive layer | Interlayer + protective layer | Light-insensitive layer/(photo-sensitive layer + light-insensitive layer) ratio | Sharpness | Develop-ment fog increase |
|---|---|---|---|---|---|---|
| 6 (Invention) | — | 0.1 | 0.2 | 0.2/0.3 [66%] | 98 | 0.01 |
| 7 (Invention) | 0.2 | 0.1 | — | 0.2/0.3 [66%] | 98 | 0.01 |
| 11 (Comparative) | — | 0.18 | — | 0/0.18 [0%] | 94 | 0.03 |
| 12 (Invention) | 0.03 | 0.12 | 0.03 | 0.06/0.18 [33%] | 95 | 0.01 |
| 13 (Invention) | — | 0.12 | 0.06 | 0.06/0.18 [33%] | 94 | 0.01 |
| 14 (Invention) | 0.06 | 0.12 | — | 0.06/0.18 [33%] | 94 | 0.01 |
| 15 (Invention) | 0.06 | 0.06 | 0.06 | 0.12/0.18 [66%] | 95 | 0 |
| 16 (Invention) | — | 0.06 | 0.12 | 0.12/0.18 [66%] | 94 | 0 |
| 17 (Invention) | 0.12 | 0.06 | — | 0.12/0.18 [66%] | 94 | 0 |

As can be seen in Table 2, the samples of the present invention are excellent. In other words, the samples comprising an anti-irradiation colorant incorporated in the light-insensitive layer according to the present invention are extremely little liable to fogging and can exhibit an excellent sharpness as compared with the comparative samples.

As mentioned above, the present invention can provide a photothermographic material which exhibits an excellent sharpness, a low Dmin, a good transparency and little fog.

EXAMPLE 3

Sample No.18 were prepared in the same manner as in Sample No. 16 of Example 2 except that the cyanine dye compound (7) set forth below was used in place of the cyanine dye compound (5). Sample No.18 had the same performance as Sample No. 16.

Cyanine Dye Compound (7)

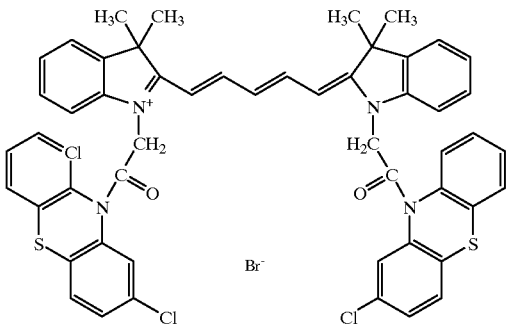

While the invention has been described in detail and with reference to specific embodiments thereof, it will be apparent to one skilled in the art that various changes and modifications can be made therein without departing from the spirit and scope thereof.

What is claimed is:

1. A photothermographic material comprising a support, a photosensitive layer comprising an organic silver salt, a reducing agent, a photosensitive silver halide, and an anti-irradiation pigment, and a light-insensitive layer comprising an anti-irradiation dye on the same side of the support as the photosensitive layer.

2. The photothermographic material according to claim 1, wherein the photosensitive layer comprises a polyhalogen compound.

3. The photothermographic material according to claim 1, wherein at least one layer on the same side of the support is free of mercury compound and comprises a polyhalogen compound.

4. The photothermographic material according to claim 1, wherein all layers on the photosensitive layer side of the support exhibit a total anti-irradiation optical density of 0.05 to 2.0.

5. The photothermographic material according to claim 1, wherein all layers on the photosensitive layer side of the support exhibit a total anti-irradiation optical density of 0.05 to 1.0.

6. The photothermographic material according to claim 1, wherein the photosensitive layer exhibits an anti-irradiation optical density of 0.05 to 1.0 and the light-insensitive layer is colored by not less than 30% of the total anti-irradiation optical density of all layers on the photosensitive layer side of the support.

7. The photothermographic material according to claim 1, wherein the light-insensitive layer is colored by not less than 50% of the total anti-irradiation optical density of all layers on the photosensitive layer side of the support.

8. The photothermographic material according to claim 1, wherein the photosensitive silver halide is spectrally sensitized.

* * * * *